US009364112B2

(12) United States Patent
Sundaresan

(10) Patent No.: US 9,364,112 B2
(45) Date of Patent: Jun. 14, 2016

(54) SECURE AND PORTABLE APPARATUS FOR ACCEPTING PARCELS AND DELIVERIES

(71) Applicant: Kumar Sundaresan, Cerritos, CA (US)

(72) Inventor: Kumar Sundaresan, Cerritos, CA (US)

( * ) Notice: Subject to any disclaimer, the term of this patent is extended or adjusted under 35 U.S.C. 154(b) by 0 days.

(21) Appl. No.: 14/682,087

(22) Filed: Apr. 8, 2015

(65) Prior Publication Data

US 2015/0305538 A1 Oct. 29, 2015

Related U.S. Application Data

(60) Provisional application No. 61/980,644, filed on Apr. 17, 2014.

(51) Int. Cl.

| | |
|---|---|
| ***A47G 29/124*** | (2006.01) |
| ***A47G 29/122*** | (2006.01) |
| ***A47G 29/20*** | (2006.01) |

(52) U.S. Cl.

CPC ..... *A47G 29/124* (2013.01); *A47G 29/1225* (2013.01); *A47G 29/20* (2013.01)

(58) Field of Classification Search

CPC ..... A47G 29/124; A47G 29/1225; A47G 2029/1226; A47G 2029/141; A47G 2029/144; A47G 29/20; A47G 29/30; B65D 22/00; B65D 33/28; B65D 33/34; E05B 73/0005; E05B 73/0011; Y10T 70/409; Y10T 70/5031; Y10T 70/5035

USPC ..... 232/19, 34–36, 45; 383/42; 340/5.73, 340/568.1, 569; 70/18, 63, 64

See application file for complete search history.

(56) References Cited

U.S. PATENT DOCUMENTS

| | | | | | |
|---|---|---|---|---|---|
| 651,256 | A * | 6/1900 | May | B65D 33/14 | 383/71 |
| 665,942 | A * | 1/1901 | Tabler | B65D 33/28 | 383/2 |
| 1,847,969 | A * | 3/1932 | Letcher | A47G 29/20 | 232/42 |
| 2,159,279 | A | 5/1939 | Lipowsky | | |
| 4,785,960 | A | 11/1988 | Belisle | | |
| 5,624,071 | A * | 4/1997 | Sosan | A47G 29/20 | 232/1 B |
| 6,155,715 | A * | 12/2000 | Lake | A47G 29/20 | 150/102 |
| 6,375,070 | B1 | 4/2002 | Snoke | | |
| 6,588,656 | B2 | 7/2003 | Cox | | |
| 6,604,390 | B1 * | 8/2003 | Nooner | B65D 55/14 | 109/50 |
| 7,305,858 | B1 * | 12/2007 | Wu | B60R 7/087 | 109/47 |
| 8,358,195 | B2 | 1/2013 | Giles | | |
| 8,358,199 | B2 | 1/2013 | Nesling | | |

(Continued)

FOREIGN PATENT DOCUMENTS

| | | |
|---|---|---|
| GB | 2424919 A | 10/2006 |
| GB | 2462284 A | 2/2010 |
| WO | 0009841 A1 | 2/2000 |

*Primary Examiner* — William Miller

(57) ABSTRACT

This invention is a secure and portable apparatus and is of parcel bag-type receptacle that can be placed for a limited time, outside a front-door or place of access to a mail carrier. The apparatus can be securely connected to a pre-existing doorknob of the front door or pre-existing door handle on or near the front door for a mail carrier to deliver a package, lock up the parcel bag, so that only the resident or authorized recipient can access the parcel upon their return. The locking mechanism in the parcel bag is one-way, thereby, once locked; even the package delivery person will not be able to access the package. The secure storage system neither damages nor requires any permanent alterations to the property structures at or near the front-door. It is portable and can be carried along during one's travel.

25 Claims, 41 Drawing Sheets

(56) References Cited

U.S. PATENT DOCUMENTS

| | | | |
|---|---|---|---|
| 8,573,473 | B1 | 11/2013 | Farentinos et al. |
| 8,661,862 | B2 | 3/2014 | Mikolajczyk et al. |
| 2012/0269461 | A1 | 10/2012 | Proctor et al. |
| 2013/0077896 | A1 | 3/2013 | Wiley et al. |
| 2014/0000322 | A1 | 1/2014 | Williams |

* cited by examiner

Figure 1a - Examples of Circular Doorknobs
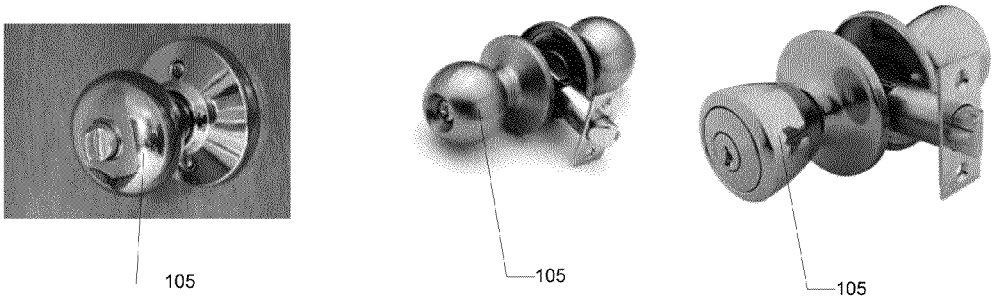
Figure 1b - Examples of Straight-Shaped Doorknobs
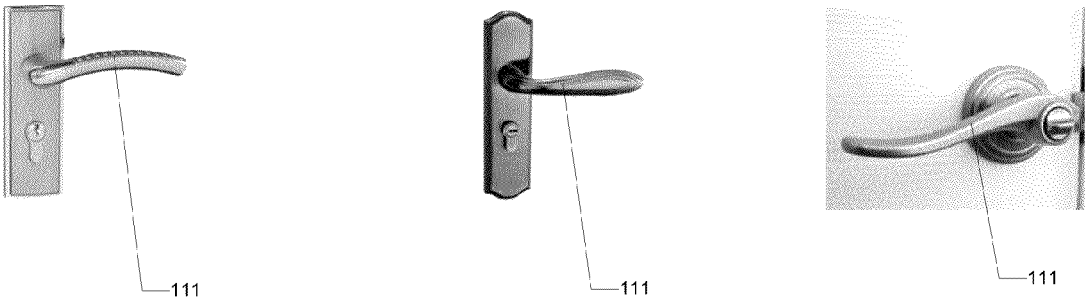
Figure 1c - Examples of Door Handles
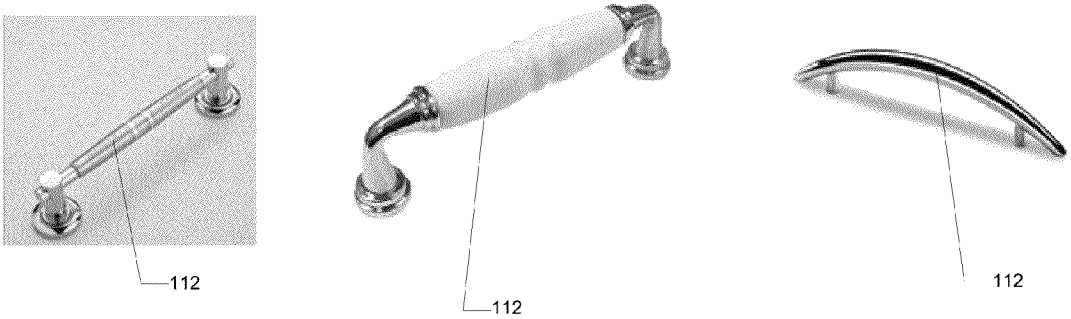

Figure 10b
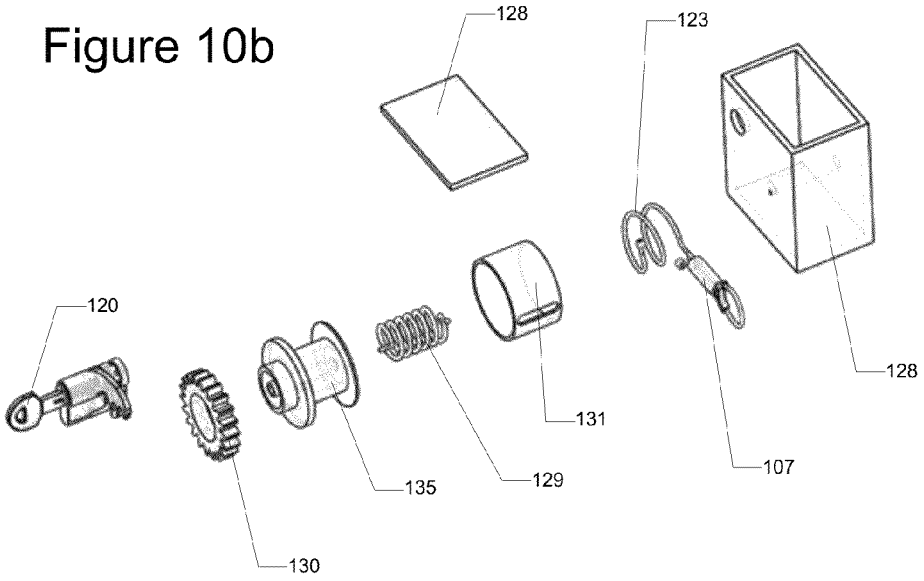
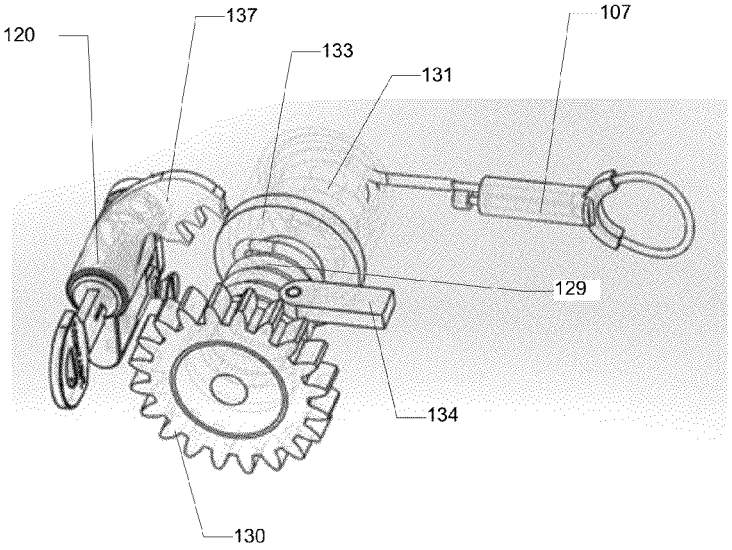
Figure 10c

Figure 10d
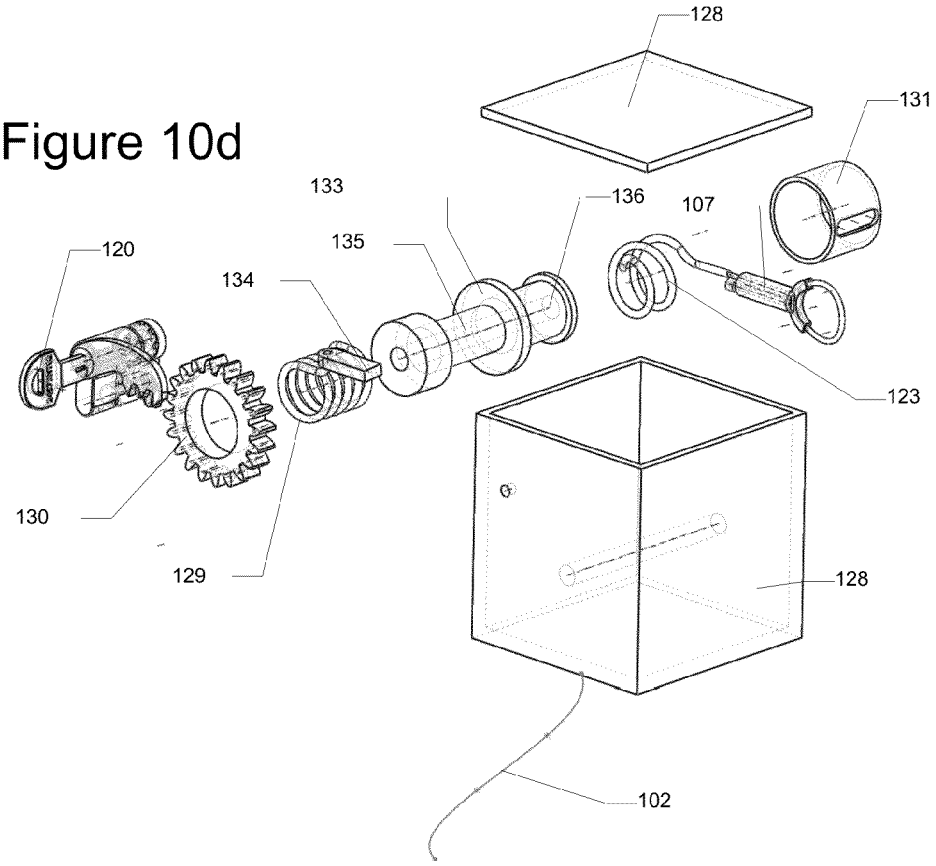
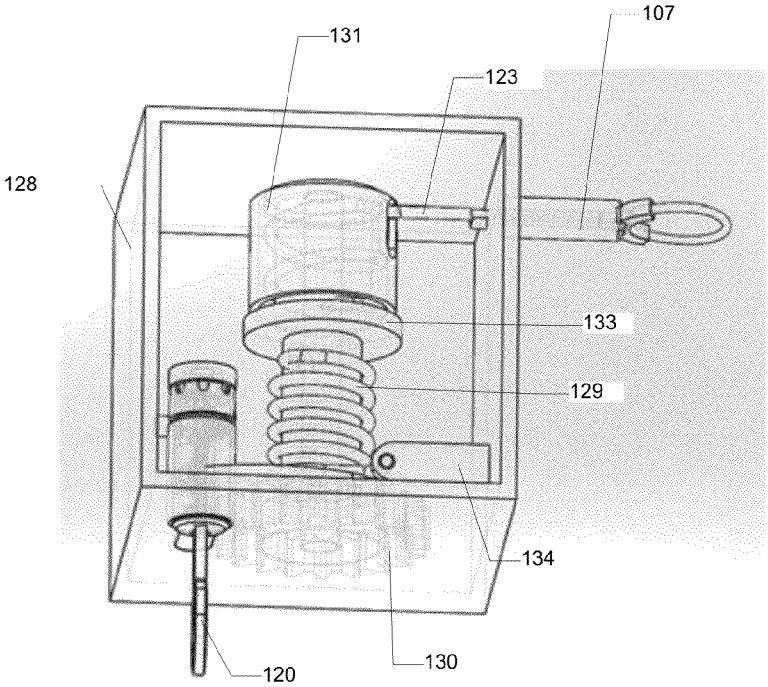
Figure 10e

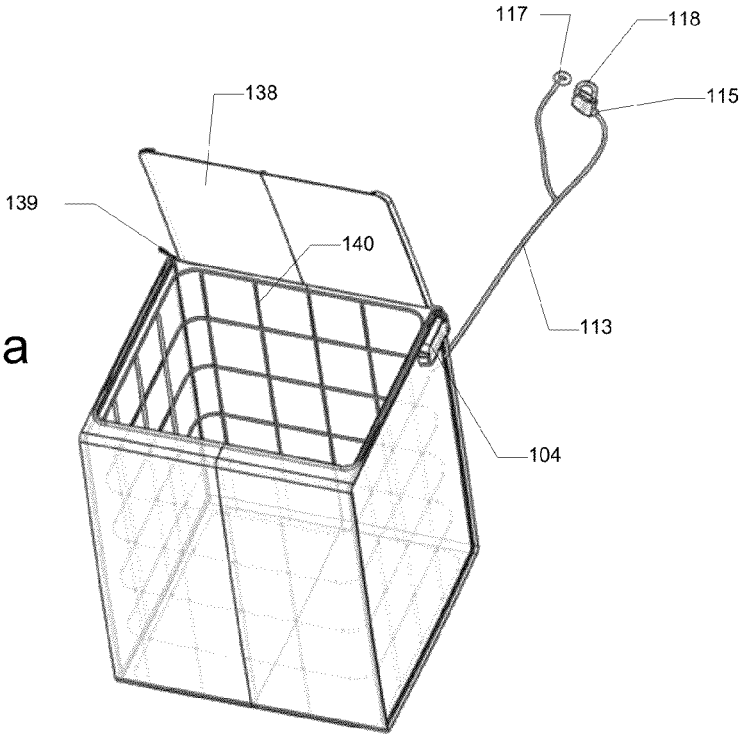
Figure 12a
Figure 12b
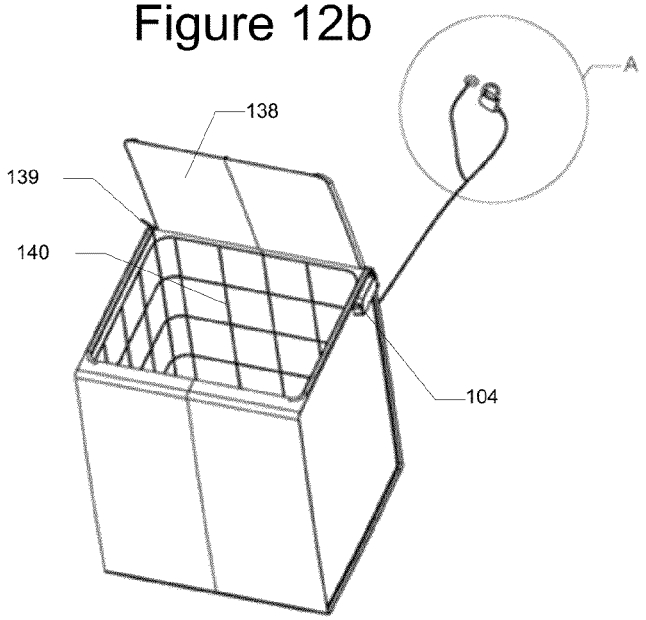
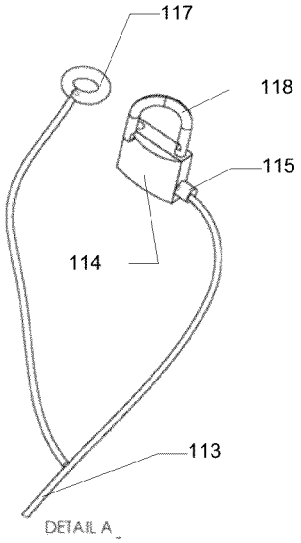
Figure 12c

Figure 21a
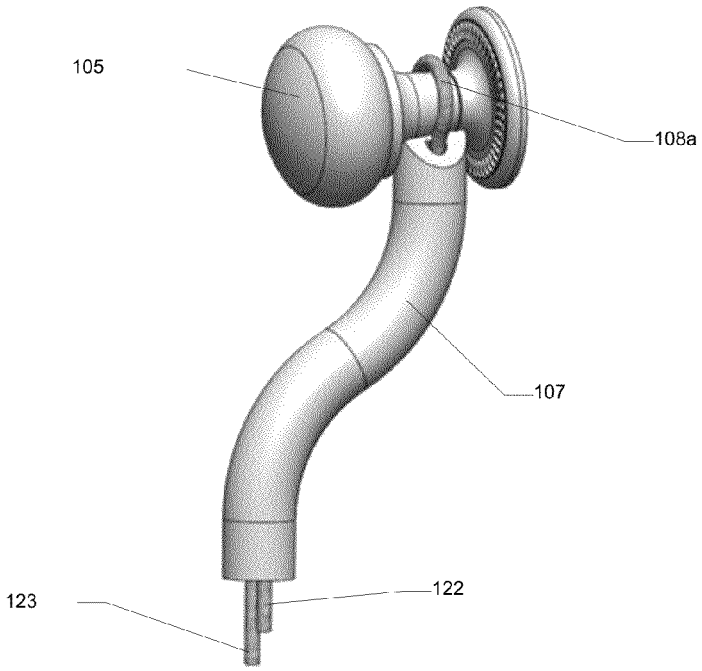
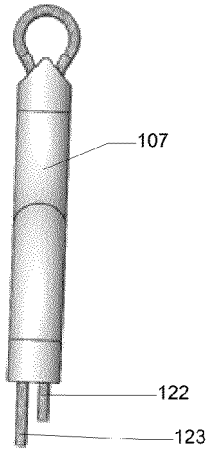
Figure 21b
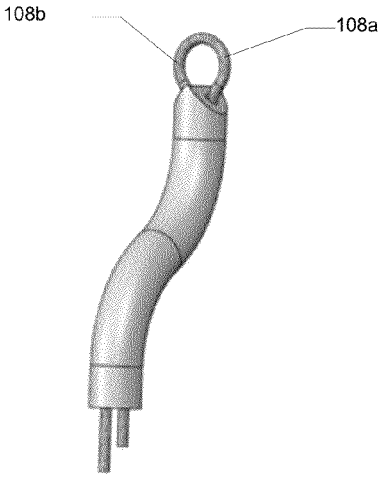
Figure 21c
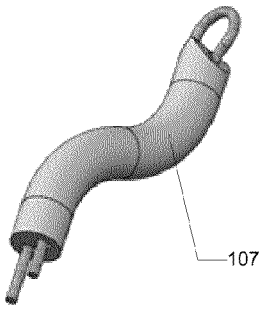
Figure 21d Figure 22a
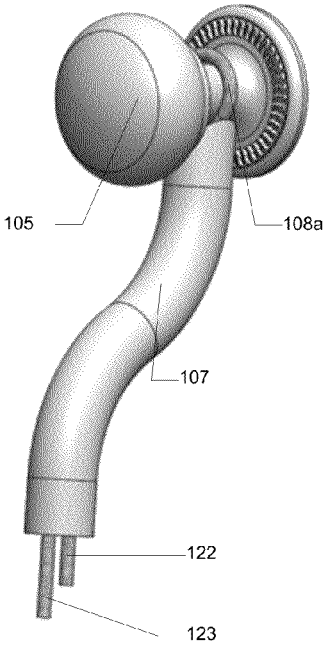
Figure 22b
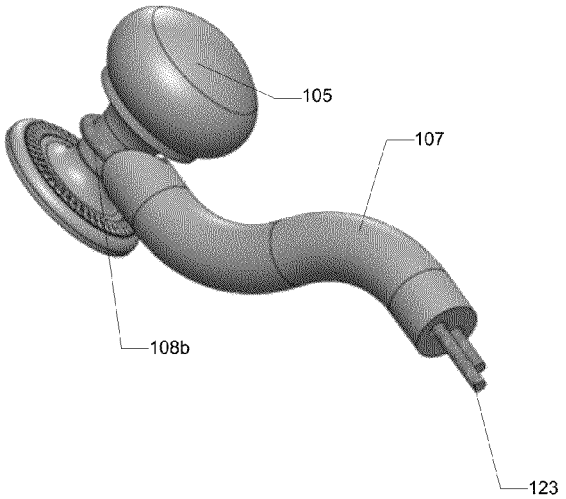
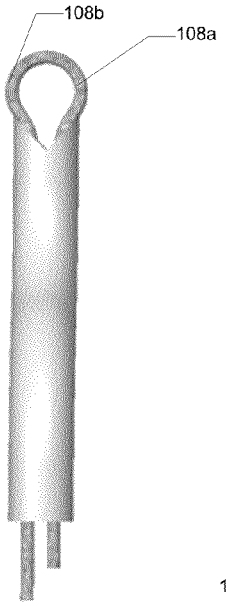
Figure 22c
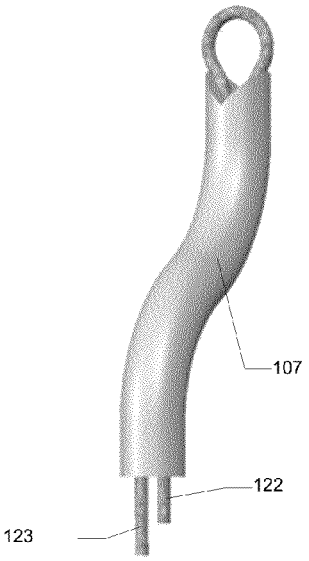
Figure 22d
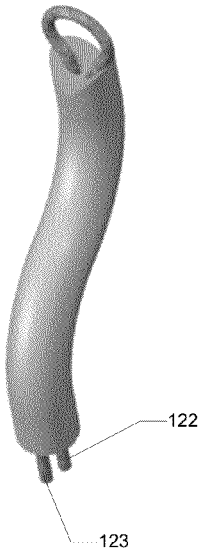
Figure 22e Figure 23
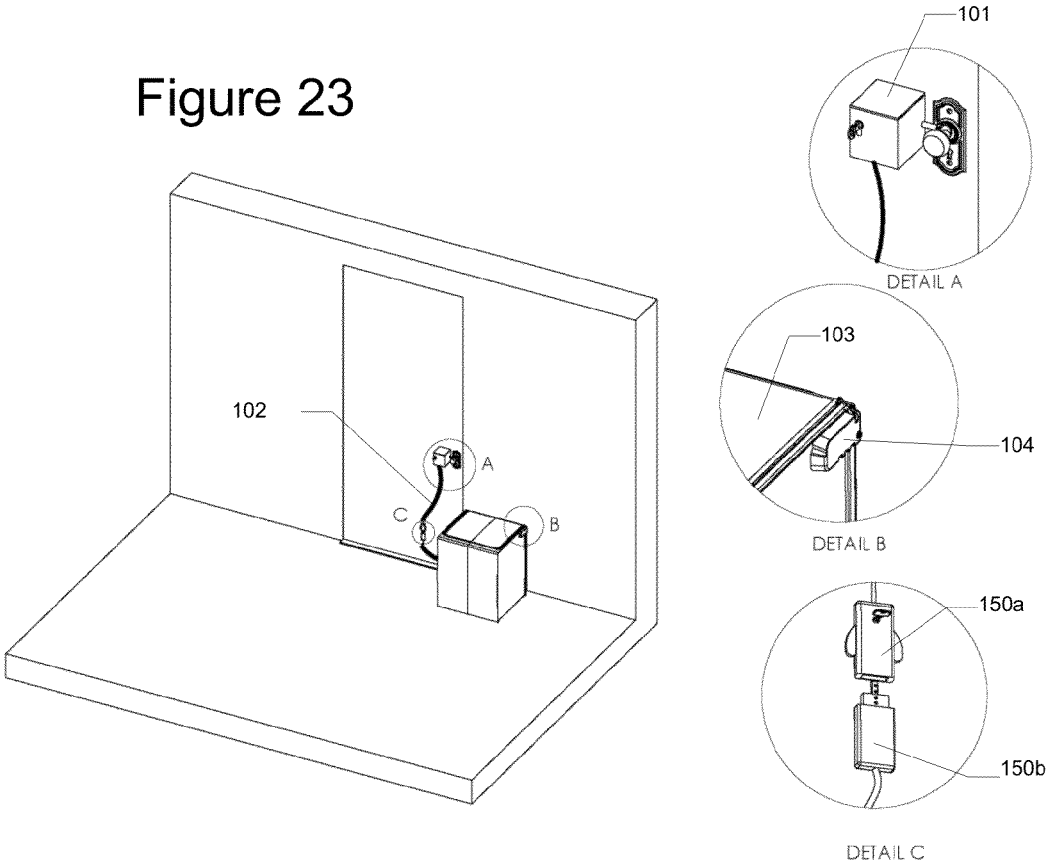
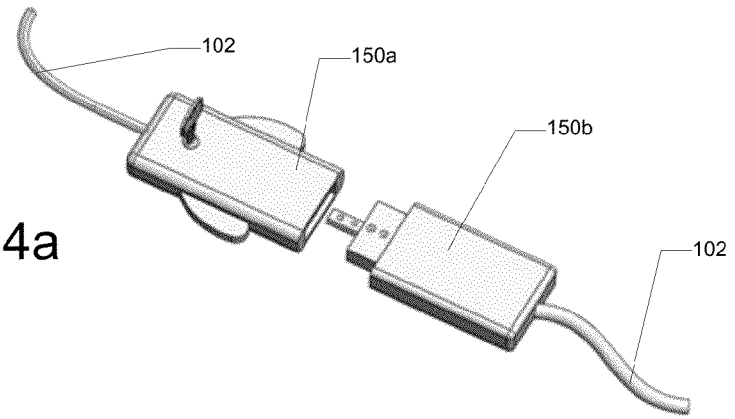
Figure 24a
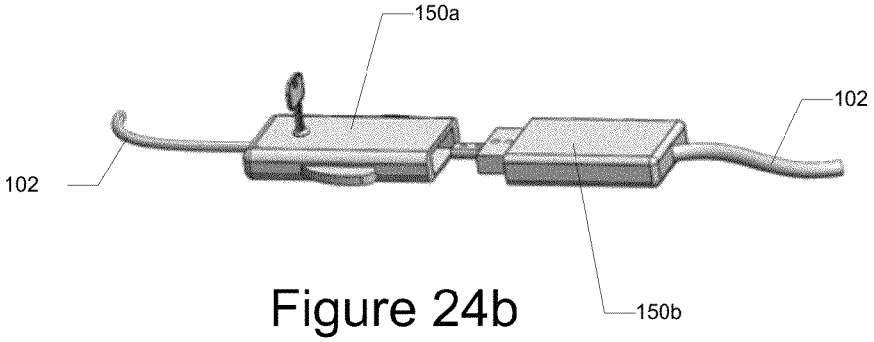
Figure 24b Figure 25a
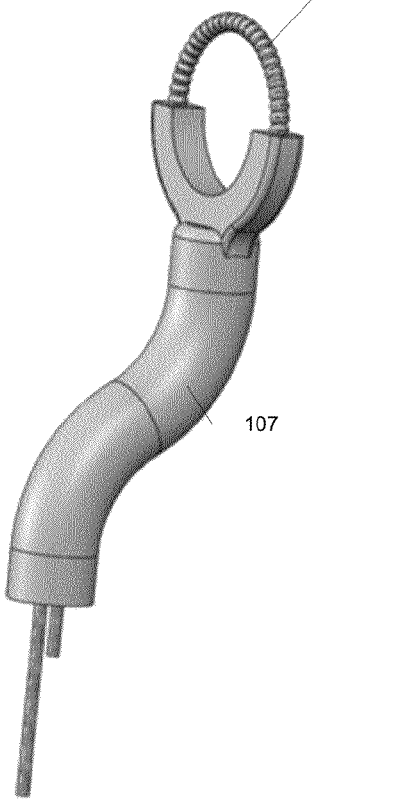
Figure 26a
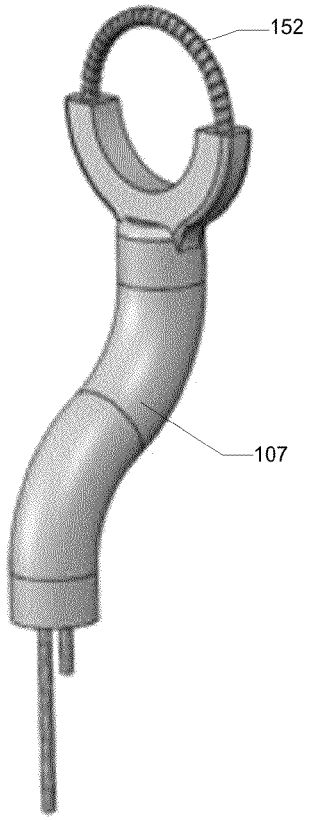
Figure 25b
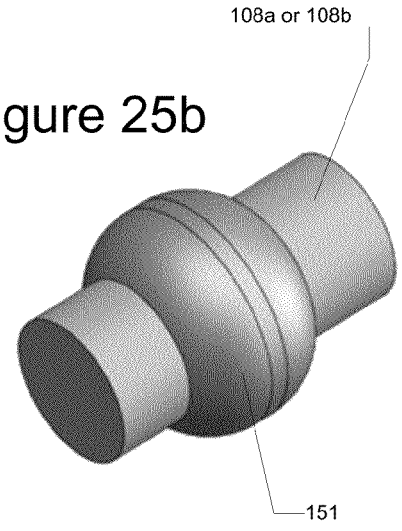
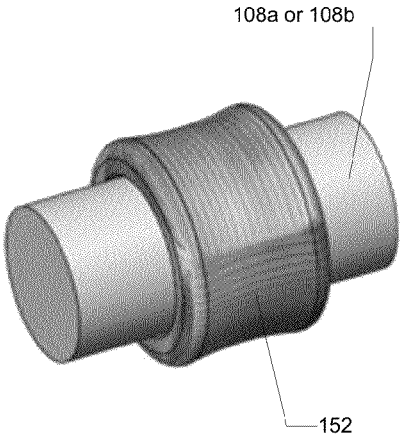
Figure 26b Figure 28e
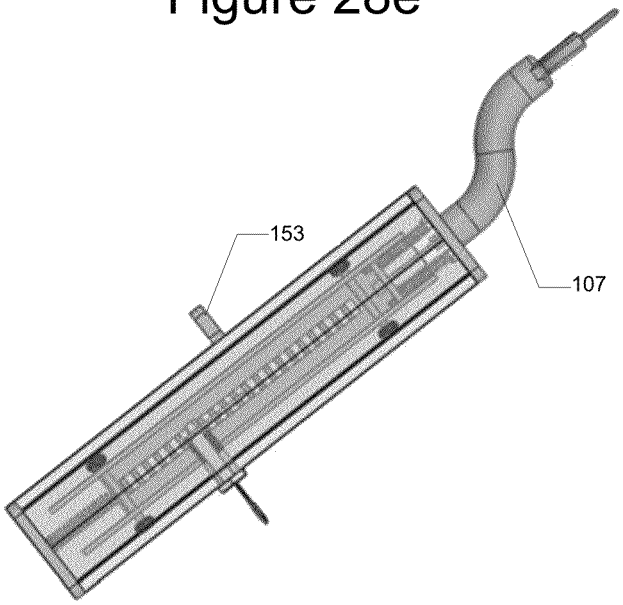
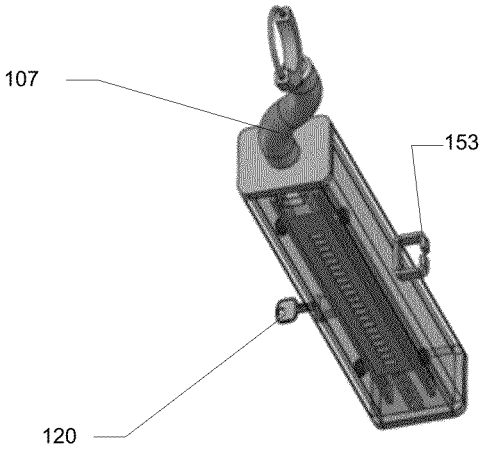
Figure 28f

SECURE AND PORTABLE APPARATUS FOR ACCEPTING PARCELS AND DELIVERIES

CROSS-REFERENCE TO RELATED APPLICATIONS

This application claims priority under 35 USC §119(e) to U.S. Provisional Patent Application Ser. No. 61/980,644, filed in the USPTO on Apr. 17, 2014, which is incorporated by reference for all purposes.

BACKGROUND

In the internet age, more and more consumers of the world rely on companies such as Amazon.com in the US, and many other online retailers in other parts of the World to shop, and to receive their parcels when they are away. When the value of parcel increases and when the recipient is away, the delivery person often either chooses to leave a note at the front-door asking the recipient to collect the parcel at a later time from a nearby pick-up locations of the carrier, or attempts to re-deliver at a later point of time. Both these options cause tremendous time delays and inconvenience, and defeat the original objective of shopping online in a very time-efficient manner from the comfort of one's home or office. Past attempts to solve the problem of receiving deliveries while the recipient is away at work or outside their temporary or permanent residences or place of their businesses have been unsatisfactory.

Additionally, many luxury apartment complexes, hotels and other places of stay do not allow their residents to permanently alter or do anything outside their front door to help the resident(s) to securely receive packages delivered by UPS, FedEx, DHL, onTrac or any other mail carrier. In fact, many luxury apartments, in the hope of offering their elite residents a clutter-free appearance in the hallway and/or exquisite living experience in their property, have very strict rules, and impose many restrictions for living. Residents are not allowed to leave anything outside their front-door even for a few hours, and property managers and staff frown upon and even impose fines on residents who violate any of their strict rules.

Related art includes US Publication No: US2012/0269461, Security Receptacle For Packages invented by Proctor and Evans, U.S. Pat. No. 6,375,070, titled Postal Delivery Apparatus and Method of Postal Delivery And Receipt issued to Snoke, U.S. Pat. No. 8,358,199, Delivery Container, issued to Nestling. Other related art includes U.S. Pat. No. 6,588,656, titled Enhanced-security Delivery Receptacles for Parcels, U.S. Pat. No. 8,573,473 by Ferentinos, U.S. Pat. No. 8,661,862 issued to Ryszard et al and U.S. Pat. No. 8,358,195 issued to Giles.

SUMMARY OF THE INVENTION

The above-listed attempts by other inventors at providing a mechanism to address the growing need to securely receive parcels at a doorstep in my opinion is still inadequate and does not address all the limitations and constraints for practical implementations. In addition, none of them fully addresses all of the practical issues, and include all of the features of my invention mentioned below. The various embodiments of the present invention utilize pre-existing doorknobs or door handles. The entire assembly or apparatus, which includes a novel doorknob lock assembly, is portable and can be quickly and easily, attached or detached, and carried along. There is no need to do any drilling or installation of any permanent or semi-permanent mounting brackets or time-consuming set-ups at the time of use that cause any damage to the front-door or any of its adjacent vicinity to make this operational in order to fulfill the intended objectives. The entire assembly can be securely installed or removed within a few minutes on the day of its intended use. A one-way locking mechanism in a parcel bag allows the delivery personnel to deliver, lock and secure the package so that only the intended recipient is able to have access to the parcel. An optional audible intrusion alarm sounds to deter any unauthorized tampering or forceful entry or actions to retrieve contents of the parcel bag. The invention uses a tamper-proof cable, rope or chain to secure the entire assembly. The various embodiments use flexible or rigid or semi-rigid parcel bag of varying size to accommodate receipt of most common sizes of packages to suit one's shopping needs.

The following essentially summarizes the key elements of the various embodiments, and the details of its operation are described in other pertinent sections:

Doorknobs or Door handles: The various embodiments of the invention involve utilizing the doorknobs and/or door handles for achieving its purposes. Doorknobs are of two types, a) circular [FIG. 1*a*] and b) non-circular [FIG. 1*b*]. Door handles are of many types as shown in FIG. 1*c*.

Secure: None of the elements of my mechanism can be removed by any unauthorized individuals.

Portable: This method and mechanism can be packed up in a bag or suitcase and can be taken along during travel to utilize it wherever and whenever necessary.

Non-intrusive: This method and mechanism neither damages nor alters anyone's property at its place of use and can be utilized just on the day or a few hours of its intended use, and can be removed entirely and stored inside at all other times.

Removable & Temporary: The various embodiments are removable and NOT permanently attached to anything. Once the parcel is received and objectives are met, it can be removed and stored inside.

A Parcel bag: The various embodiments involve utilization of a tamper-proof, flexible or rigid or semi-rigid bag that can be used by a mail carrier to deliver the parcel. This bag can be kept outside one's front-door for a mail carrier to drop off the package and lock it up for the parcel recipient to retrieve later on.

One-way Locking Mechanism: There are two places where locking mechanisms could be potentially utilized in this method, mechanism and apparatus. First, close to the doorknob or door handle to secure and tighten the cable or rope or chain mechanism to prevent removal of the doorknob lock assembly from the doorknob or door handle. Second, a lock to secure the parcel bag after placing the package inside it and to ensure the mail personnel can lock it prior to his/her departure upon delivery. By one-way, it is inferred that a delivery personnel can put a package or parcel inside a bag, but not be able to remove upon locking the parcel bag assembly. No one, not even the mail carrier, can access the package upon locking the parcel bag. Only the recipient will be able to access and retrieve the parcel. The locking and unlocking mechanism can be a) simple, conventional physical type involving combination locks or traditional locks or can optionally have other embodiments and utilize latest advancement in technologies such as b) RFID, c) Bluetooth d) mobile phone related applications or e) Wi-Fi.

Intrusion and Audible Alarm: The various embodiments optionally utilize installation of an intrusion alarm system if the cable or rope or chain is pulled forcefully or if the parcel bag and/or lock(s) is attempted to be opened or tampered with. The sound alarm will last for a preset time interval so as to not drain a battery and at the same time deter unauthorized person(s) from continuing their intrusion or tampering. This optional feature will be an embodiment where additional security is desired in certain locations or applications. An additional embodiment is also to have a feature where the decibel level of the sound and time duration of the alarm can be adjusted.

BRIEF DESCRIPTION OF THE DRAWINGS

The invention can be better understood by reference to the following illustrations, in which:

FIG. 1*a* illustrates examples of circular doorknobs;

FIG. 1*b* illustrates examples of straight doorknobs;

FIG. 1*c* illustrates examples of door handles;

FIG. 6*b* illustrates the cable diameter increasing from its initial diameter in FIG. 6*a*.

FIG. 6*c* shows a view of the cable when it is stretched to the required diameter around a doorknob;

FIGS. 6*d* and 6*e* illustrate the cable diameter decreasing and shrinking from FIG. 6*c;*

FIG. 10*a* through FIG. 10*g* illustrate the design and use of a fourth embodiment, in which the helical spring is not concentrically inside the annular space that contains the cable/rope/chain but is laterally extended out and is positioned outside and alongside on its own circular cylinder;

FIGS. 12*a* and 12*b* illustrate parcel bags where the Y-shaped cable is integrated with a riveted lock that are specifically used in applications involving door handles;

FIG. 12*c* shows an exploded view of FIG. 12*b*, detail A, wherein the Y-shaped cable is used to wrap around a door handle to secure the parcel bag to a door handle;

FIG. 21*a* shows another design where the stem is bent so as to easily hang the doorknob lock assembly vertically downward from the doorknob;

FIGS. 21*b* through 21*d* illustrate other views of FIG. 21*a*, a stem design in which A-shaped stem edge is shown;

FIGS. 22*a* through 22*e* illustrate a stem design in which a V-shaped stem edge is shown;

FIG. 23 shows the cable/rope/chain interconnecting the parcel bag and the doorknob lock assembly is broken into 2 pieces, and has a lock and key mechanism for detachment in the middle;

FIGS. 24*a* and 24*b* show a magnified view of the cable detachment and the lock and key mechanism in it;

FIGS. 25*a* and 25*b* show an optional embodiment in which the cable/rope/chain are wrapped inside a tamper-resistant strong convex circular bead;

FIGS. 26*a* and 26*b* show an additional embodiment that has concave shaped beads around the cable/rope/chain;

FIGS. 28*a* through 28*i* shows and illustrates the various inner details and exploded views of many of doorknob lock assembly 101 and its essential components and parts;

DETAILED DESCRIPTION OF THE DRAWINGS

FIGS. 1*a* through 1*c* show examples of various types of doorknobs and handles. The various embodiments can be installed on any of these door handles and utilized to receive a parcel securely. These circular doorknobs are displayed herein to facilitate explanation of usage of the various embodiments. FIG. 1*b* illustrates examples of straight-shaped doorknobs. The various embodiments can be installed on any of these straight-shaped doorknobs and utilized to receive a parcel securely. These are displayed herein to facilitate explanation of usage of the various embodiments. FIG. 1*c* shows examples of various door handles. The various embodiments of the invention can be installed on any of these door handles and utilized to receive a parcel securely.

Figure 2A:
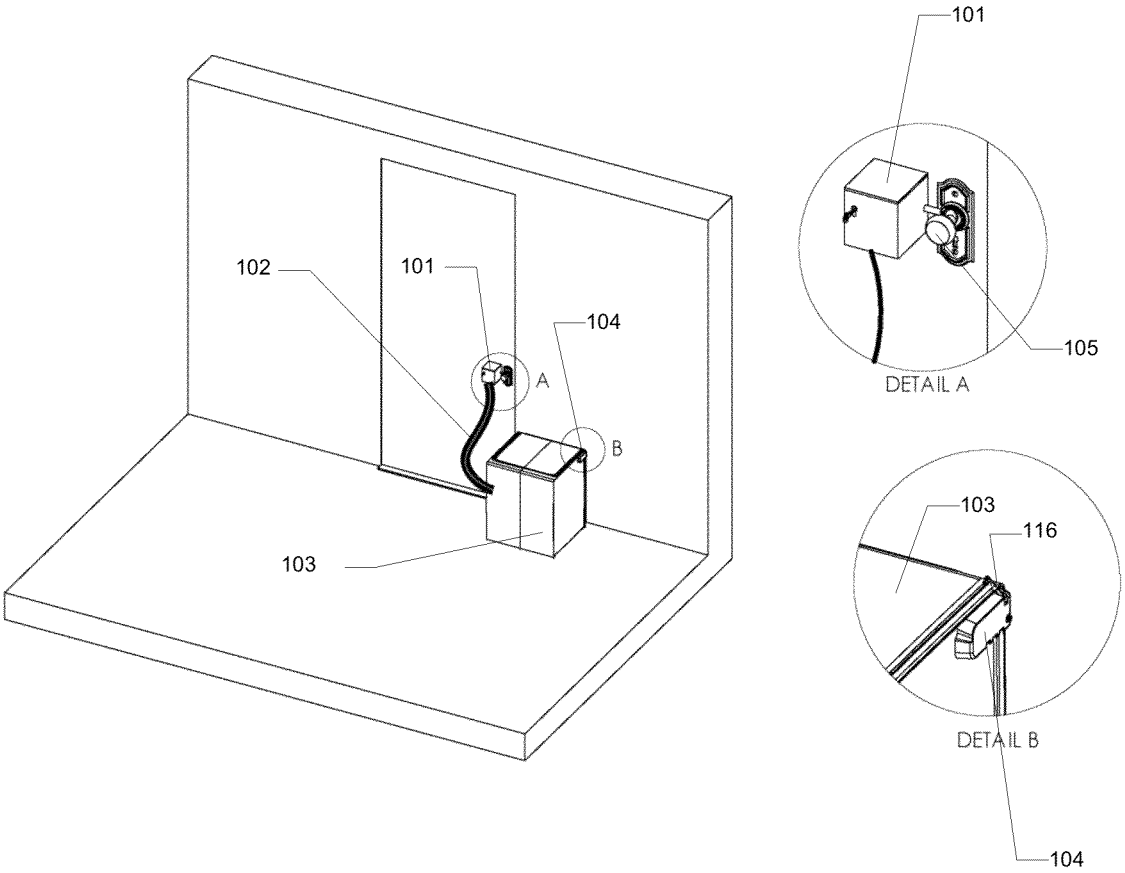
FIG. 2*a* illustrates at a high-level the security device as it-works on a circular doorknob, and shows all the associated components.
Figure 2B:
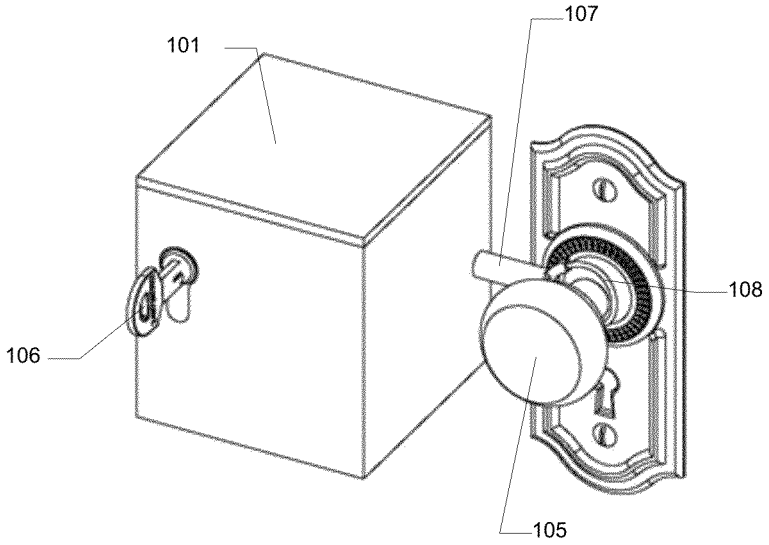
FIG. 2*b* shows an enlarged version of FIG. 2*a*, detail A.

FIG. 2*a* illustrates at a high-level how the various embodiments operate on a circular doorknob, and shows all the associated components. Two sections of FIG. 2*a* are enlarged, and are displayed as detail A and detail B for better clarity. FIG. 2*b* shows an enlarged version of FIG. 2*a*, detail A.

Figure 2C:
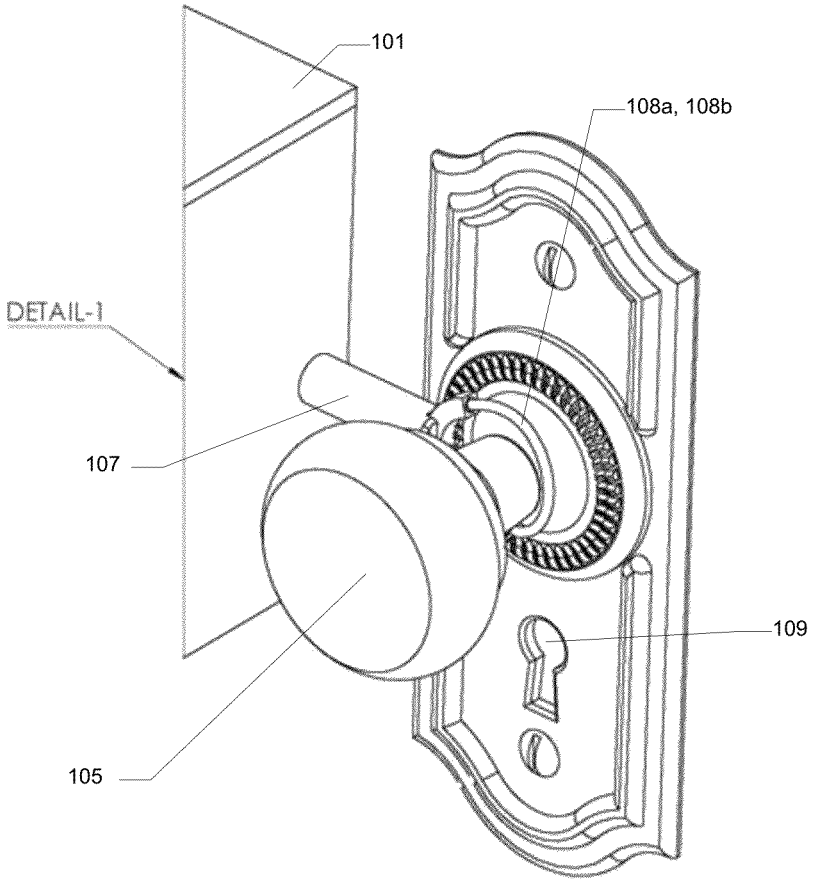
FIG. 2*c* shows an enlarged version of FIG. 2*b*, specifically showing how the cable/rope/chain is wrapped around the neck of a circular doorknob.

FIG. 2*c* shows an enlarged version of FIG. 2*b*, specifically showing how the cable/rope/chain (108*a* and 108*b*) is wrapped around the neck of a circular doorknob. In this picture, the cable 108*a* and 108*b* appears loose around the neck of the circular doorknob for illustrative purposes only. It should be noted that it is tightly wrapped around the neck without any room for the cables to be removed.

For the purposes of this invention, the word "cable" as used herein denotes a flexible member made of metal or non-metal, of sufficient strength, flexibility and characteristics to suit the intended application. As used herein, "cable" refers to a rope or chain or cable, of any suitable material.

Figure 3:
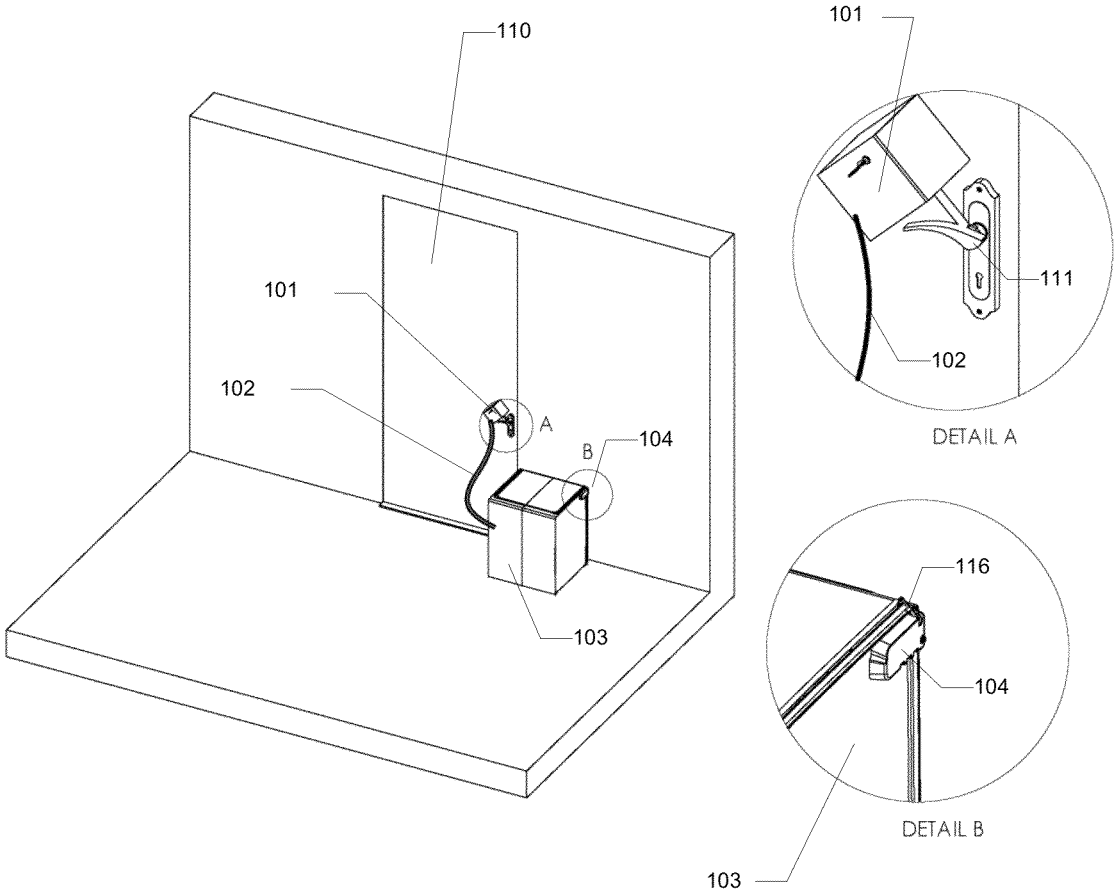
FIG. 3 illustrates at a high-level an embodiment that works on a straight doorknob. Enlarged views of the details of FIG. 3 are also shown.

FIG. 3 illustrates at a high-level how the various embodiments work on a straight doorknob, and shows all the associated components. Two sections of FIG. 3 are enlarged and are shown as detail A and detail B for better clarity.

Figure 4:
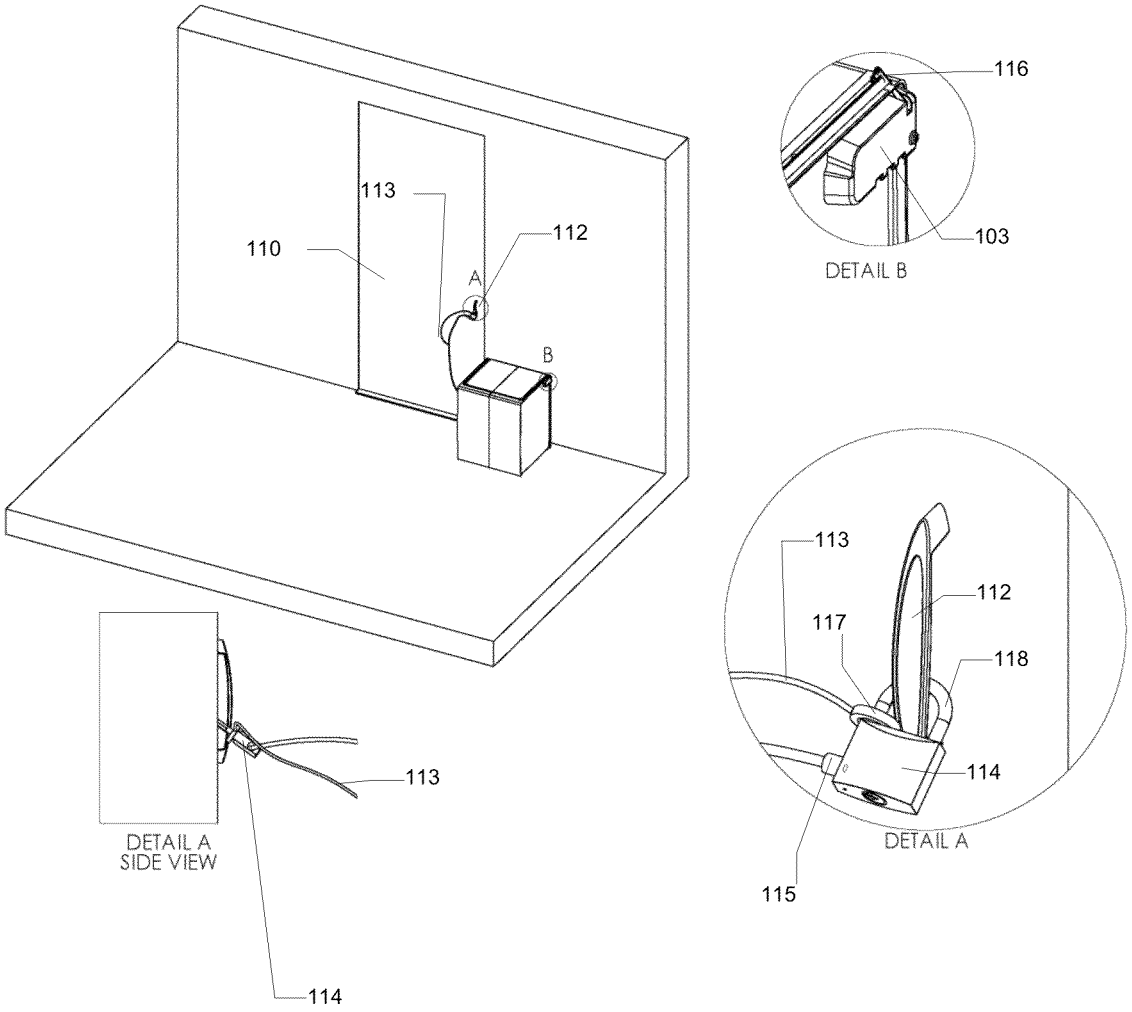
FIG. 4 illustrates at a high-level how the various embodiments work on a door handle, and shows all the associated components. Enlarged views of the details of FIG. 4 are also shown.

FIG. 4 illustrates at a high-level how the entire mechanism works on a door handle, and shows all the associated components. Two sections of FIG. 4 are enlarged, and are shown as detail A and detail B for better clarity.

Figure 5A:
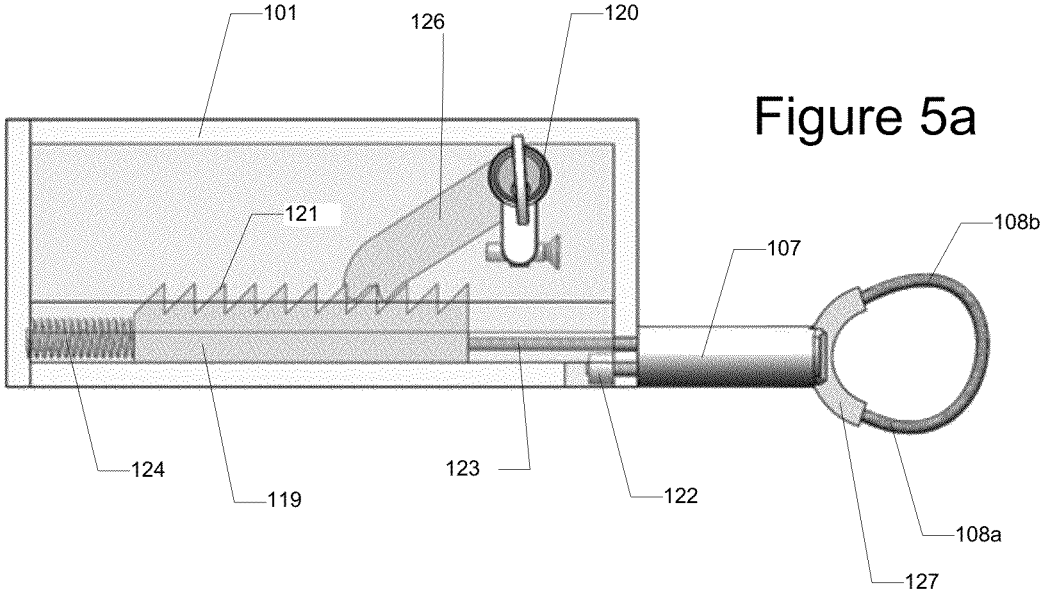
FIG. 5*a* shows a simple doorknob lock assembly that can be utilized to securely fasten to a doorknob using a cable/rope/chain and a lock/key.

FIG. 5*a* shows a simple doorknob lock assembly embodiment that can be utilized to securely fasten to a doorknob using a cable/rope/chain (108*a*, 108*b*), and a lock/key (120). This apparatus utilizes one extendable spring 124, and when cable 108*b* is pulled out to wrap it around the neck of a doorknob, this spring 124 is extended, and when it is released, this spring pulls the inverted T-shaped sliding block (119) back toward its original position so that the cable/rope/chain 108*b* remains tight around the neck of a doorknob.

Figure 5B:
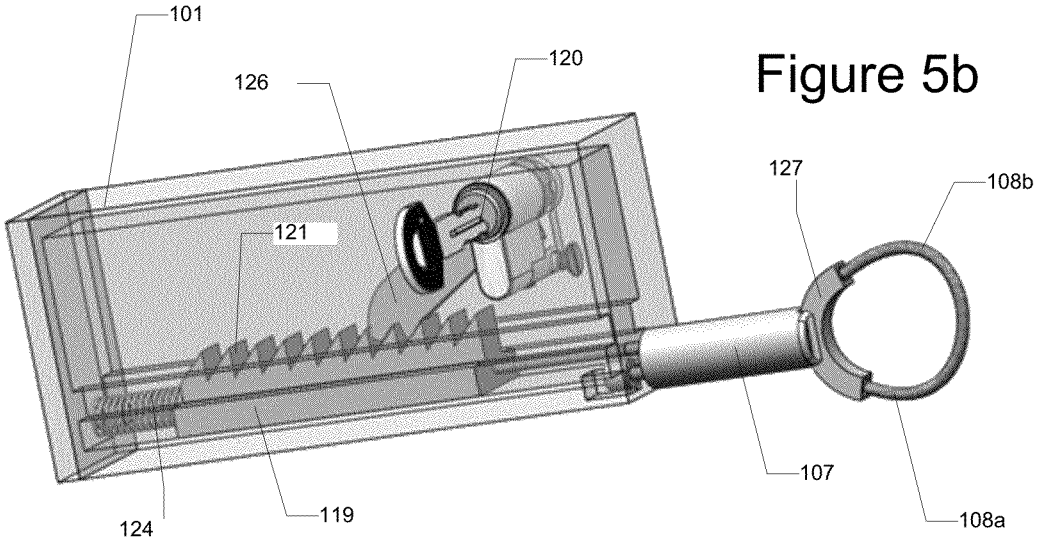
FIGS. 5*b* and 5*c* shows two different perspectives of FIG. 5*a* for better visualization and understanding.
Figure 5C:
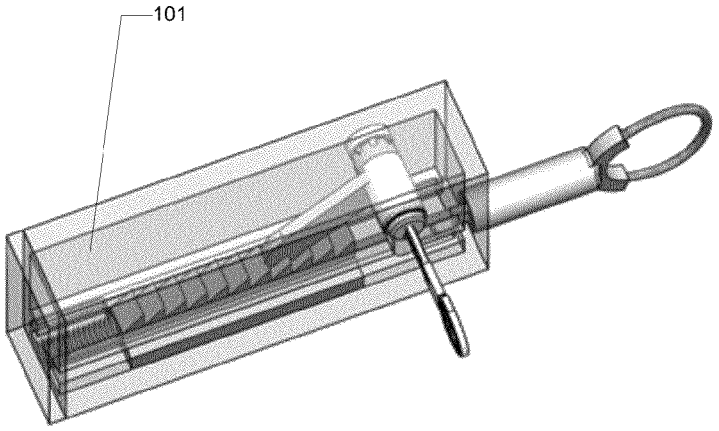
Figure 5D:
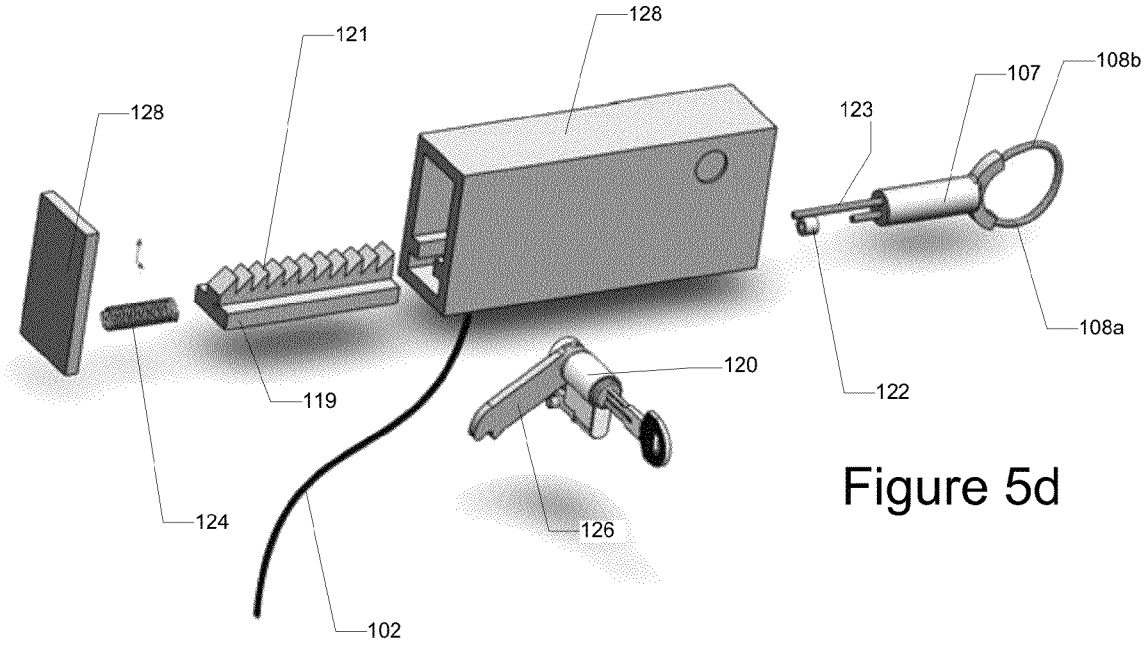
FIG. 5*d* shows an exploded version of FIG. 5*a;*

Also, it is extremely important to note that the location of lock/key 120 as shown in the figure is for descriptive purposes only. Specifically, the location of 120 can be on any of the faces of the assembly as it should be located conveniently to operate on doors where the space around the doors may be very limited depending on whether a) the doorknob is located on the left-side of the front-door, or b) on the right-side of the front-door, etc. Ideally, the lock 120 is expected to be located on the top face of the assembly so that it is very convenient to operate the lock in any kind of doorknobs located on any (right or left) sides of the front doors, and may not be situated as shown in some of these figures. FIG. 5*b* and FIG. 5*c* shows two different perspectives of FIG. 5*a* for better visualization and understanding. FIG. 5*d* shows an exploded version of FIG. 5*a*, and has all the essential components of it nicely separated from each other for enhanced clarity and distinction.

Figures 6A, 6B, 6C, 6D, 6E:
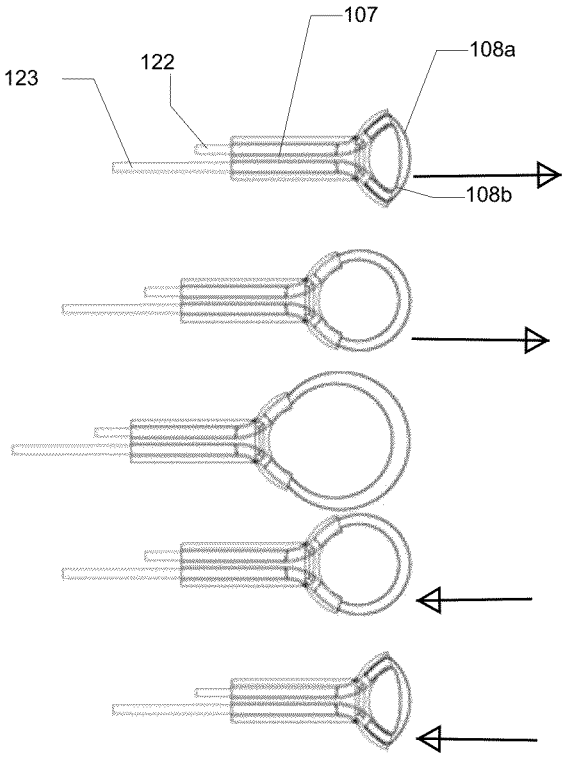
FIG. 6*a* through 6*e* illustrates how the cable/rope/chain at the edge of stem are pulled out and extended.

FIG. 6*a* through 6*e* illustrates how the cable/rope/chain (108*a*, 108*b*) at the edge of stem (107) are pulled out and extended (FIG. 6*a*, 6*b*). Once the cable is stretched to the required diameter (FIG. 6*c*) around a doorknob (such that it has been secured around it and may not be tampered with), and once the cable/rope/chain is extended sufficiently over doorknob, it is slowly released, and because of spring (124, 125) actions, the cable diameter decreases and shrinks (FIG. 6*d*, FIG. 6*e*) and contracts to tighten itself around the doorknob tightly and securely.

Figure 7A:
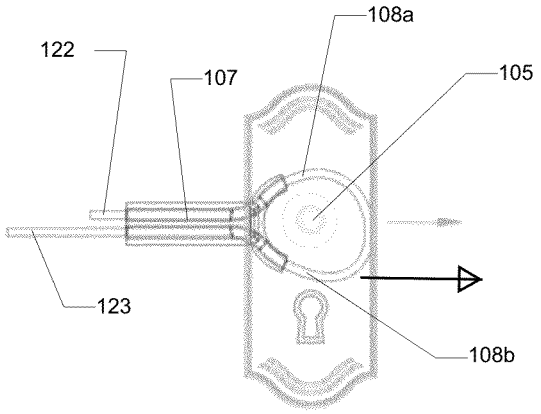
FIGS. 7*a*, 7*b* and 7*c* illustrate extensions of FIG. 6*a* through 6*e;*
Figure 7B:
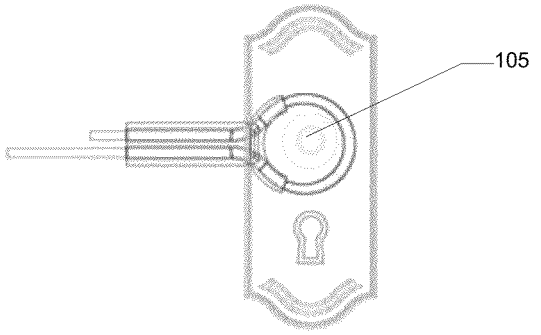
Figure 7C:
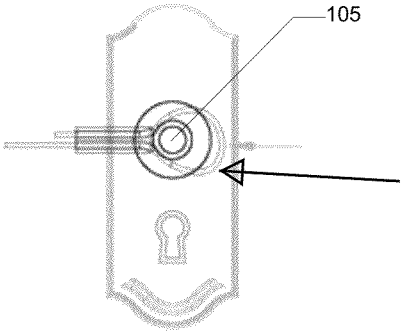

FIGS. 7*a*, 7*b* and 7*c* are further extensions of FIG. 6*a* through 6*e*, and shows how the doorknob is centered inside the almost circular shape of cable/rope/chain (108*a*, 108*b*). Arrows are shown in these figures to explain movement of cable/rope/chain at different stages.

Figure 8A:
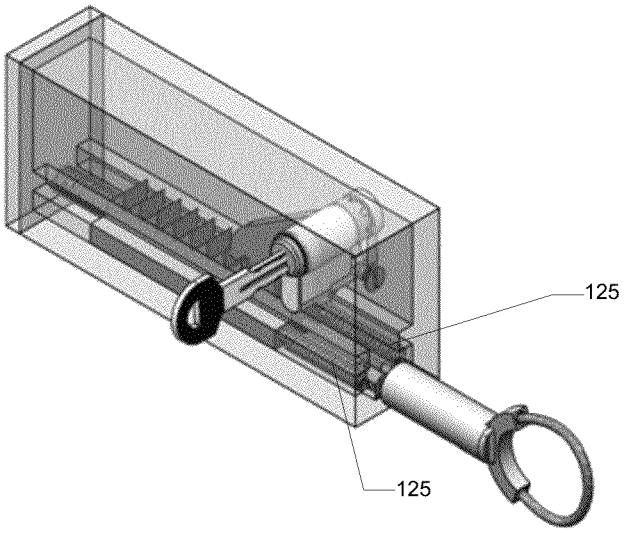
FIG. 8*a* through 8*c* illustrates an alternative embodiment, in which there are 2 additional compressible springs.
Figure 8B:
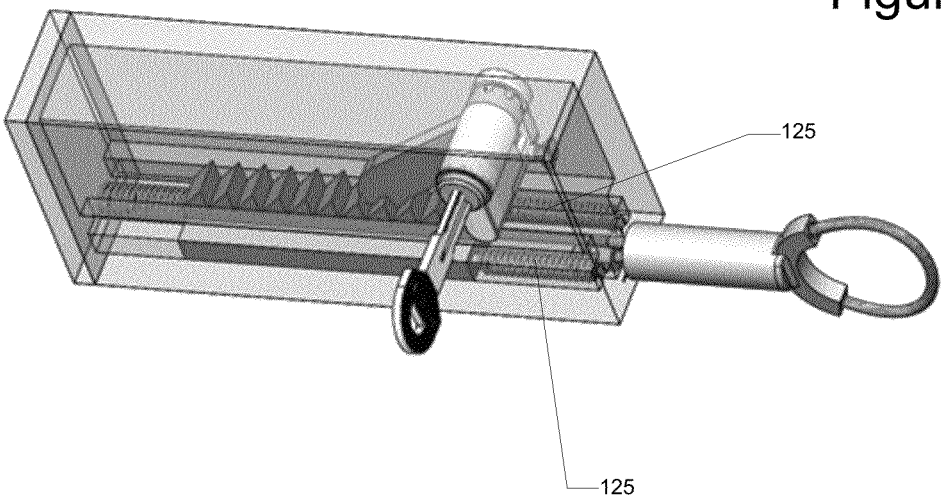
Figure 8C:
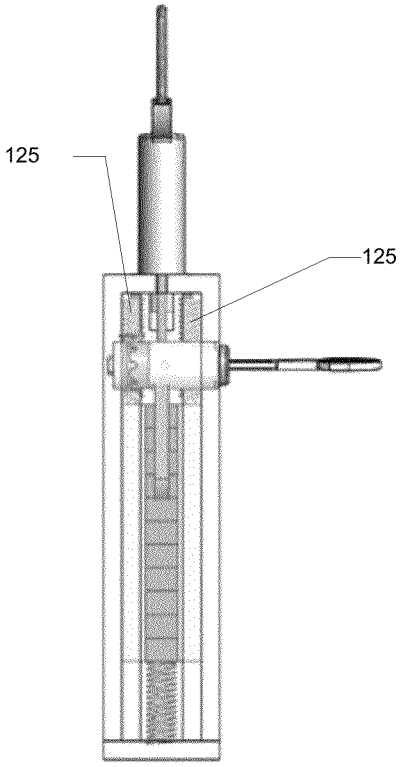
Figure 9A:
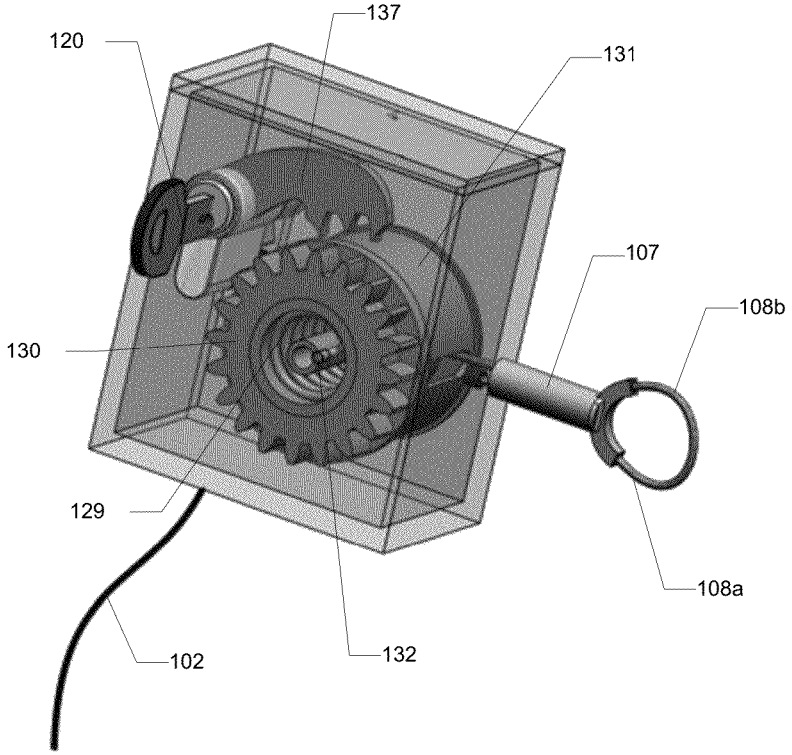
FIG. 9*a* through FIG. 9*e* illustrates the design and use of a third embodiment in which the inverted t-shaped sliding block is replaced by a circular gear mechanism.
Figure 9B:
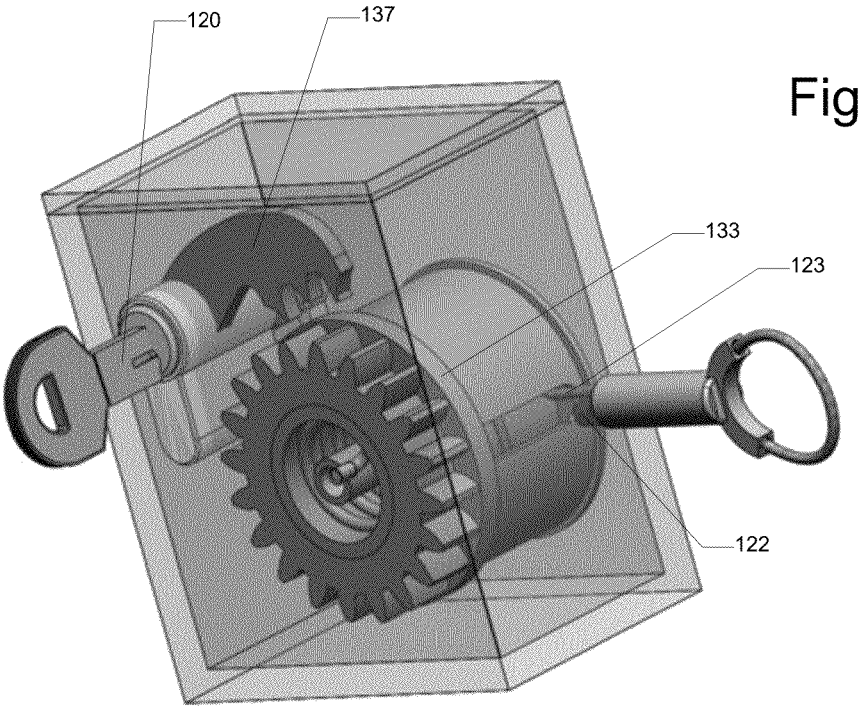
Figure 9C:
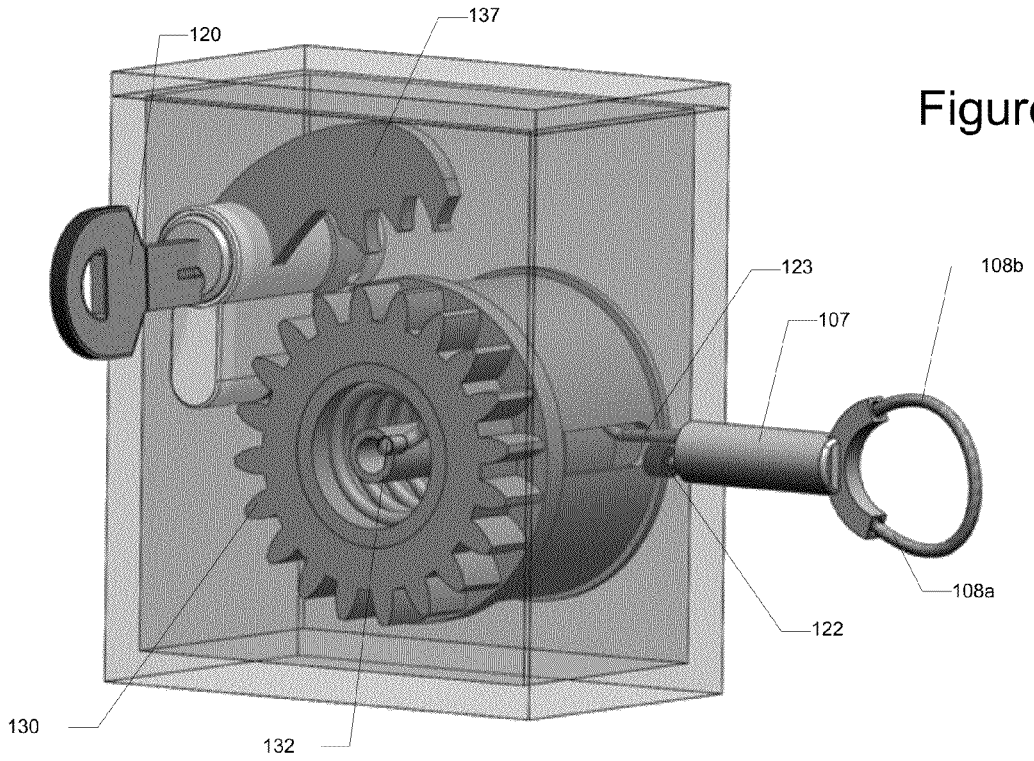
Figure 9D:
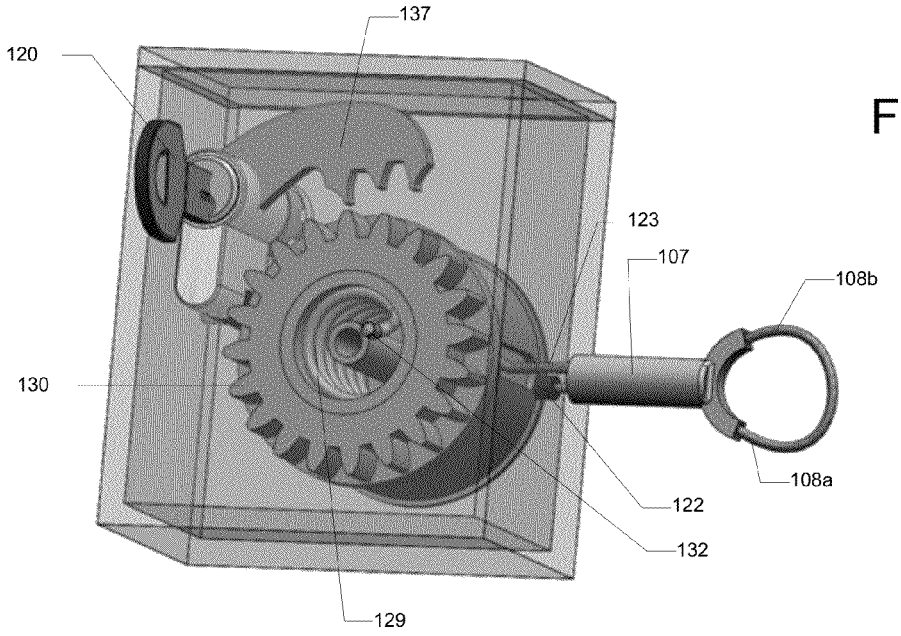
Figure 9E:
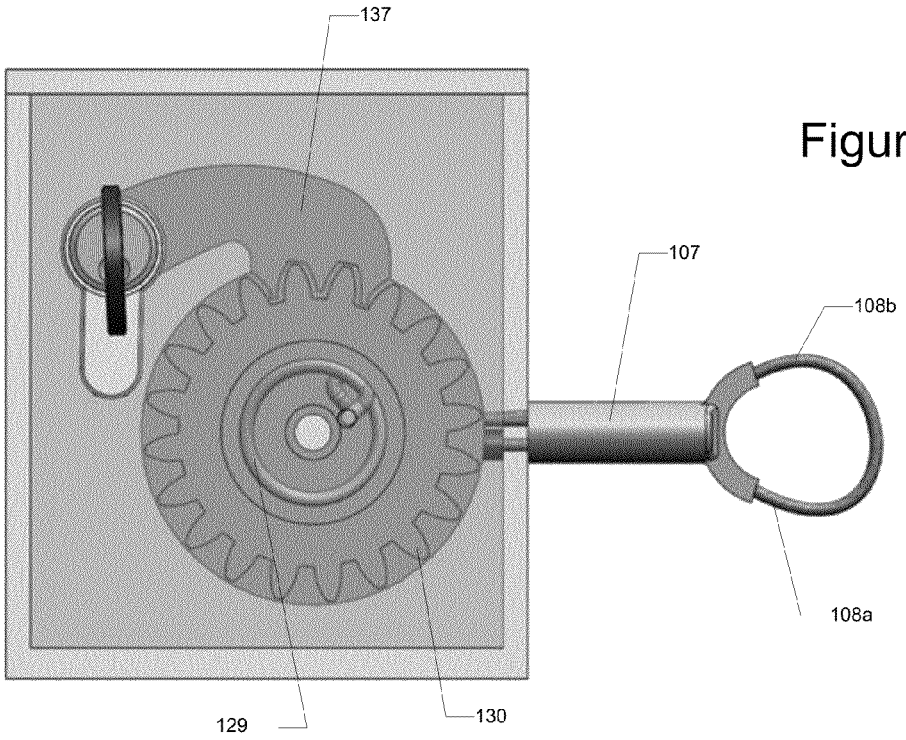
Figure 10A:
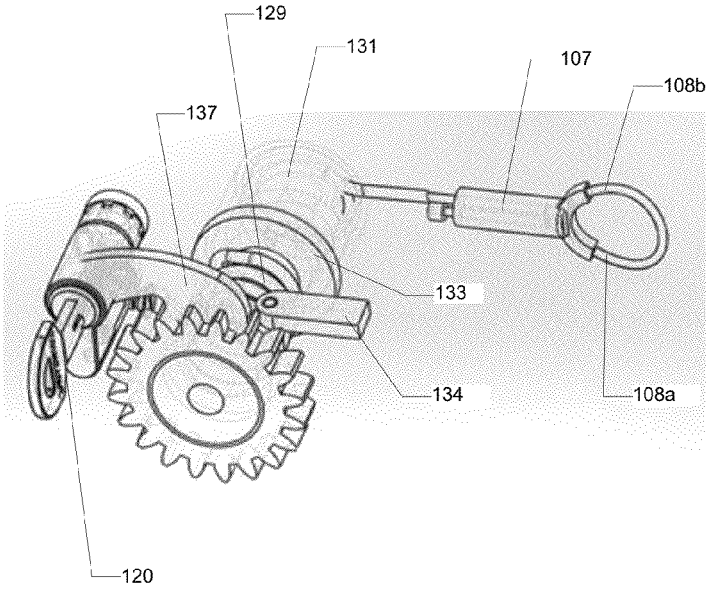
Figure 10F:
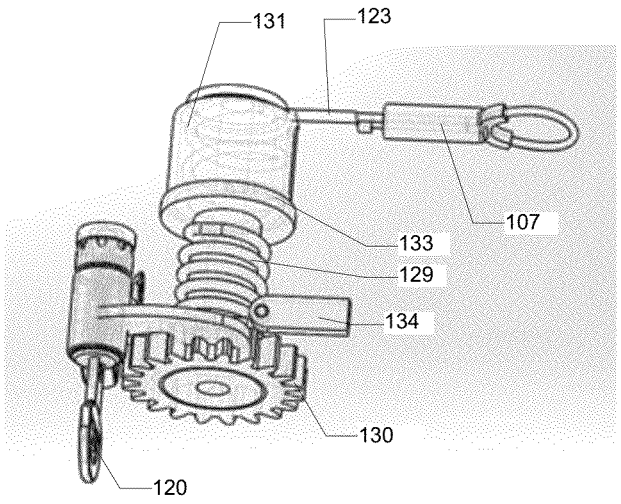
Figure 10G:
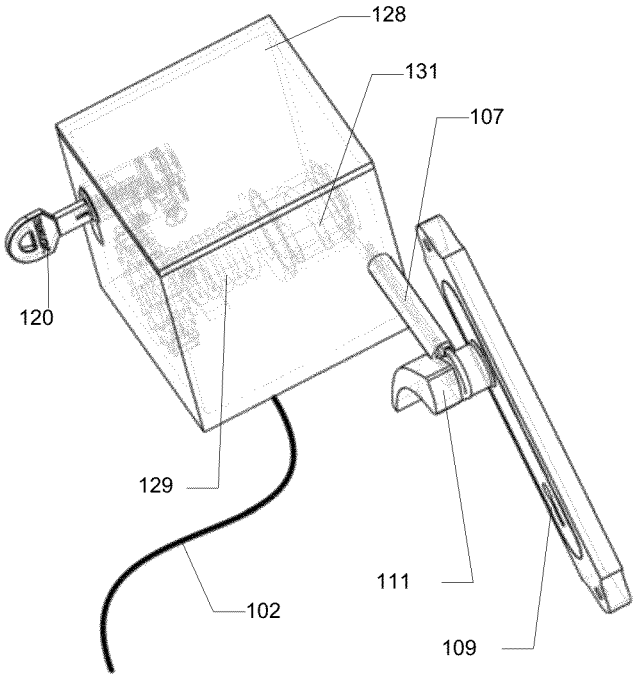

FIG. 8*a* through 8*c* show embodiments in which there are two additional compressible springs (125) that are placed to facilitate the movement of the sliding block 119 to go back to its original position once the cable/rope/chain 108*b* is extended. The spring 125 is compressed when cable 108*b* is pulled out, thereby, once the cable 108*b* is over the neck of the doorknob and released, this compressed spring automatically act on the sliding block 119 and push it back toward its original position.

FIGS. 9*a* through 9*e* illustrate the design and use of a third embodiment. In this embodiment, the inverted t-shaped sliding block 119 is replaced by a circular gear mechanism. The limitation of inverted t-shaped sliding block 119 is that the maximum length that the 108*b* can be pulled is constrained and limited by the length of the sliding assembly, and has to be of finite length only. However, this circular gear rotates when cable 108*b* is pulled out through its connecting cable 123. Because of the circular gear shape, the cable/rope/chain 108*b* can be pulled out substantially more in this embodiment, and as such there is no strict limitation as to how long one can pull the cable 108*b* to wrap it around a doorknob or any other object.

In the embodiment illustrated in FIGS. 9*a*-9*e*, springs (124, 125) are replaced by a helical spring located concentrically inside the circular gear, and this helical spring helps in pulling back cable 108*b* to ensure the cable 108*b* wraps around the neck of a doorknob tightly and securely. Other devices may replace the helical spring by providing a similar retraction (and tensioning) function, and, as such, the helical spring is described herein to communicate the idea in a descriptive sense only for a particular embodiment.

FIGS. 10*a* through 10*g* illustrate the design and use of a fourth embodiment. In the fourth embodiment the helical spring is not concentrically inside the annular space 131 that contains the cable/rope/chain 108*b*, but is laterally extended out and is positioned outside and alongside on its own circular cylinder 135. So, this embodiment tends to be slightly larger than the third embodiment shown in FIGS. 9*a* through 9*c*. However, this design is less complicated and less intricate than the earlier design, and so it is easier to maintain and replace broken, defective or failed parts in case of any problems associated with any of its components such as springs, or cables etc in case they require repair upon usage.

Figure 11A:
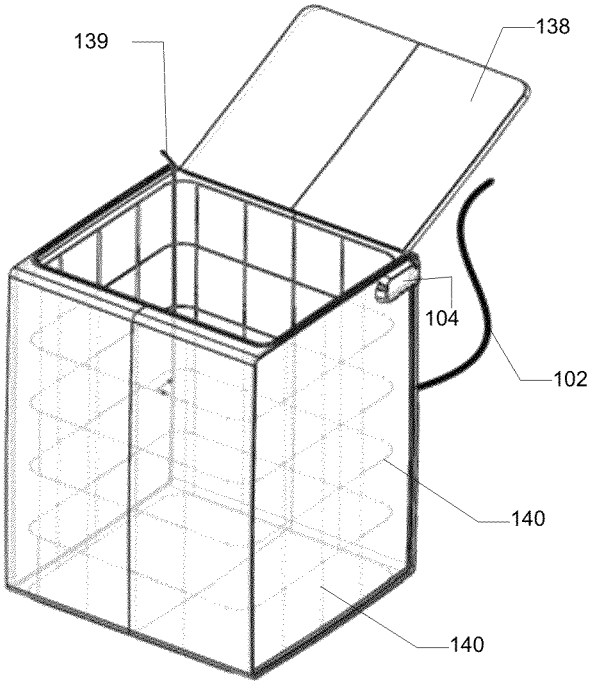
FIGS. 11*a* and 11*b* illustrate a sample parcel bag in its open and closed state, respectively.
Figure 11B:
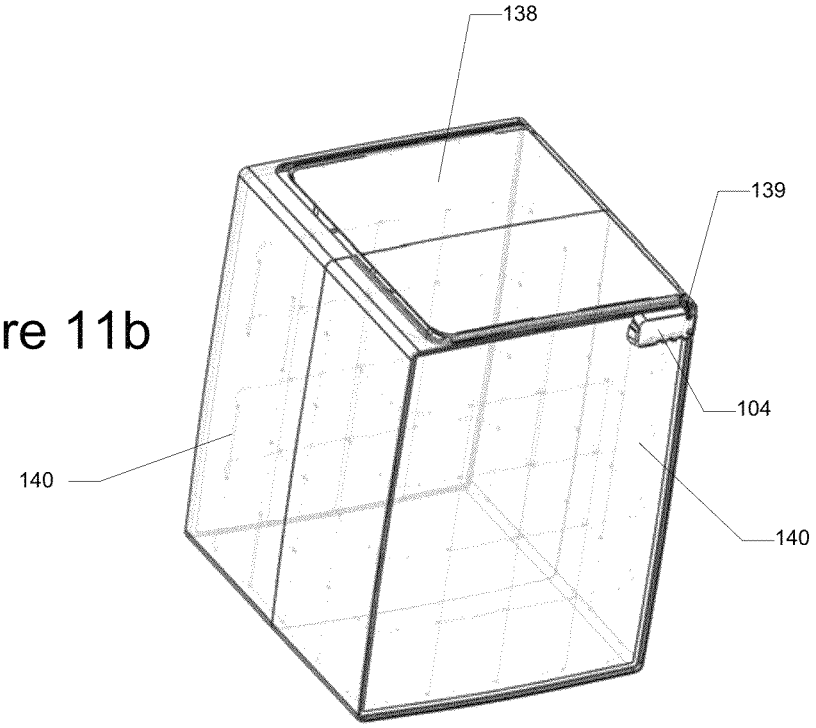

FIGS. 11*a* and 11*b* illustrate the parcel bag feature of the various embodiments in its open and closed state, respectively. FIG. 11*a* in addition shows the cable/rope/chain 102 that is connected between the parcel bag and the doorknob assembly 101. Also, in FIG. 11*a*, the zipper 139 is in open position, while in FIG. 11*b*, the zipper 139 is in closed position securely tucked inside the parcel bag lock 104.

FIGS. 12*a* and 12*b* show parcel bags where the Y-shaped cable 113 is integrated with a riveted 115 lock 114 that are specifically used in applications involving door handles. FIG. 12*c* shows an exploded view of detail A displayed in FIG. 12*b*, wherein the Y-shaped cable 113 is used to wrap around a door handle to secure the parcel bag to a door handle.

Figure 13:
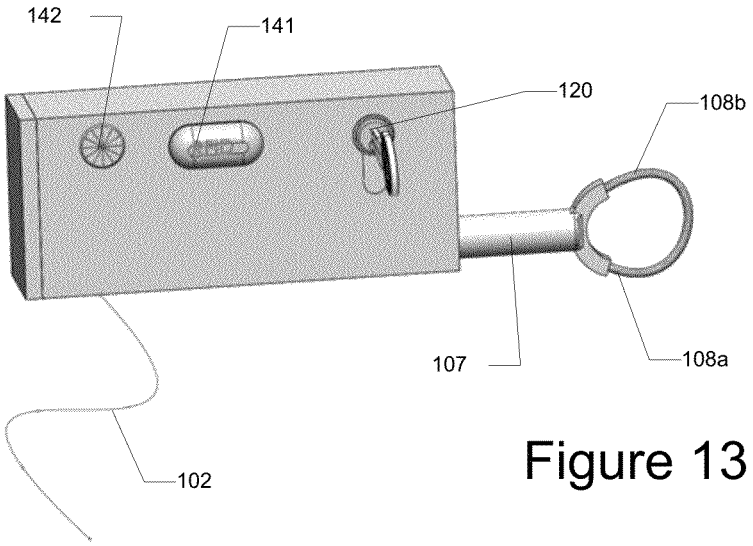
FIG. 13 illustrates how a RFID (Radiofrequency identification) can be used in lieu of a traditional lock 120 to arrest and release the movement of cable/rope/chain around a doorknob.

FIG. 13 illustrates how a RFID (Radiofrequency identification) can be used in lieu of a traditional lock 120 to arrest and release the movement of cable/rope/chain 108*b* around a doorknob. FIG. 13 also displays an optional embodiment of including a speaker 142 to sound an alert if any kind of tampering is noticed or detected on the doorknob assembly or on the interconnecting cable/rope/chain or on the parcel bag.

Figure 14:
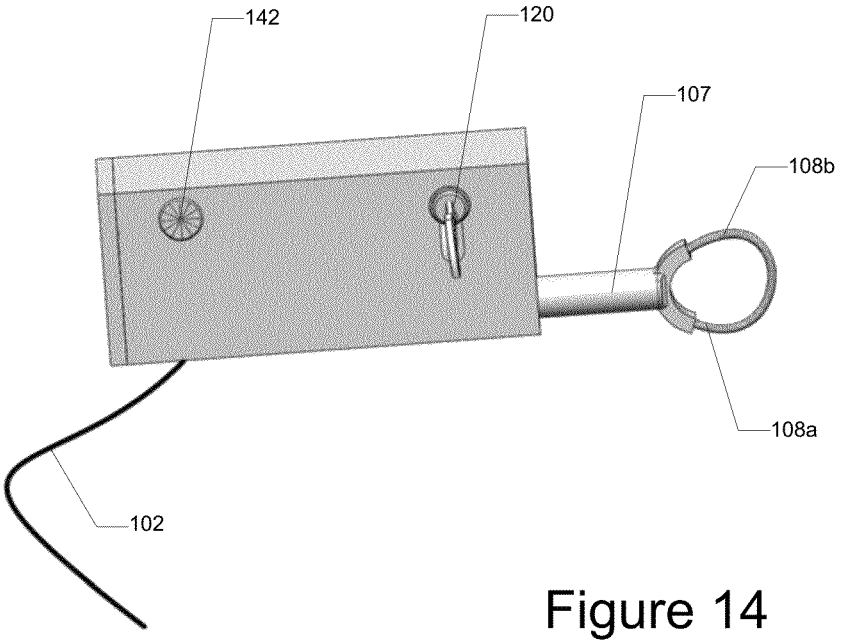
FIG. 14 is an embodiment without an RFID, and instead, it can have any other types of technological solution to replace the functions of the lock.
Figure 15A:
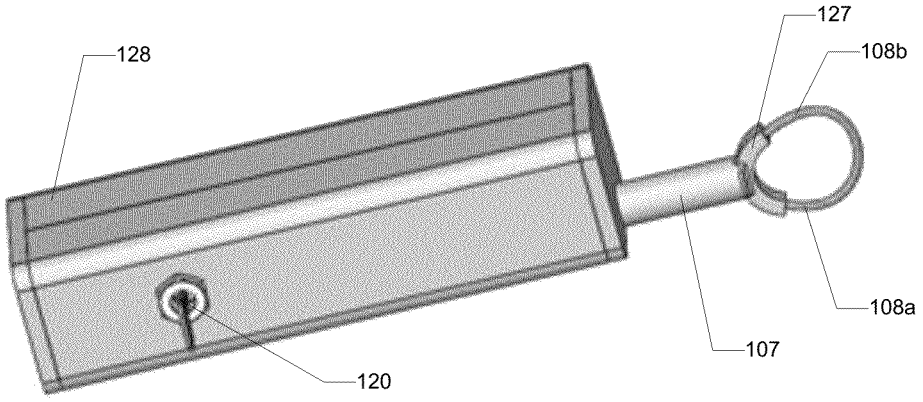
FIG. 15*a* through 15*e* illustrates a fifth embodiment of the doorknob lock assembly in which the inverted T-shaped sliding block is replaced by a simple strong thin plate that moves along two slidable grooves.
Figure 15B:
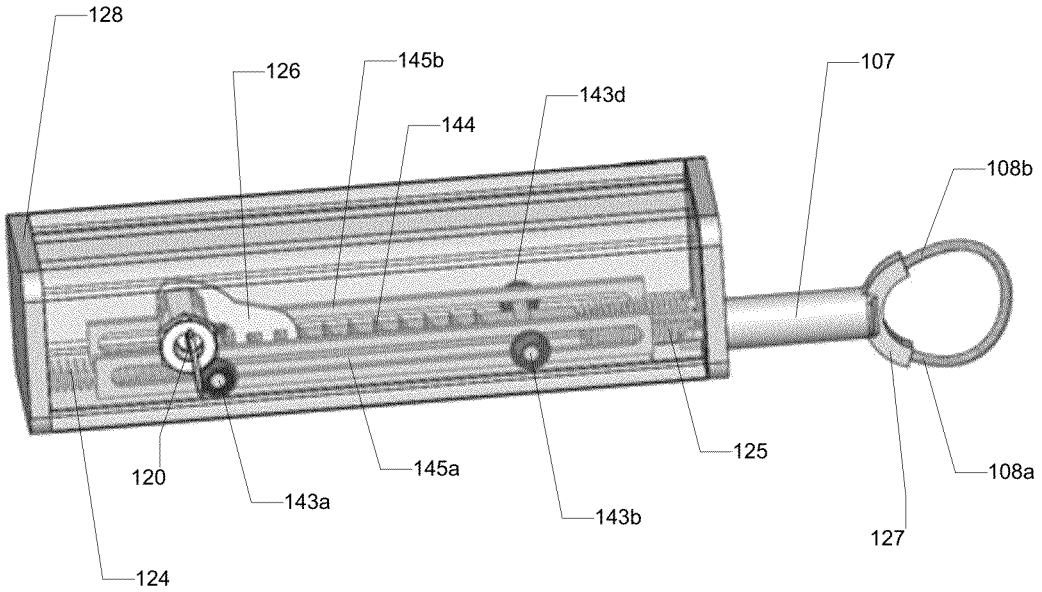
Figure 15C:
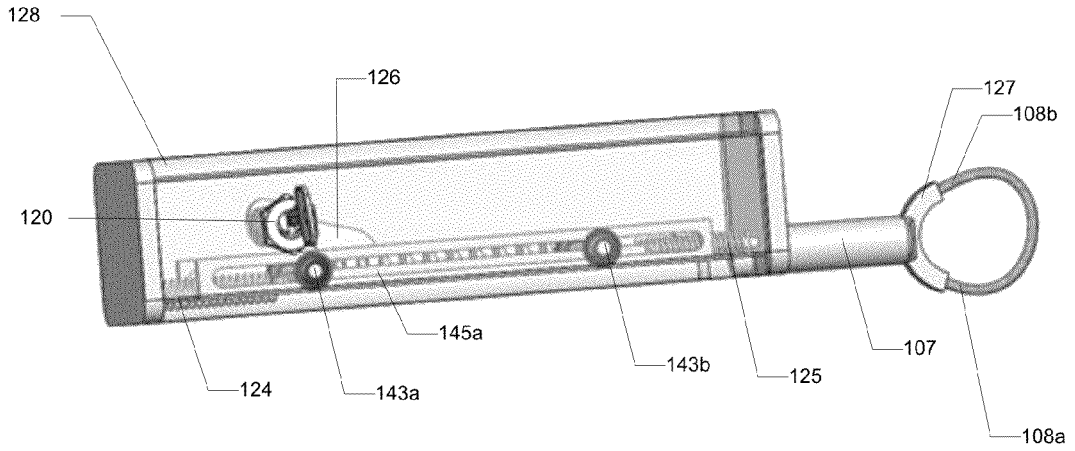
Figure 15D:
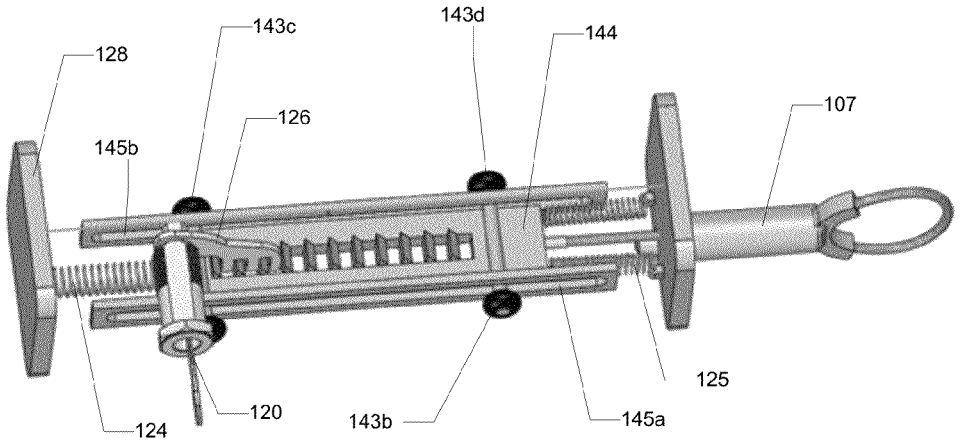
Figure 15E:
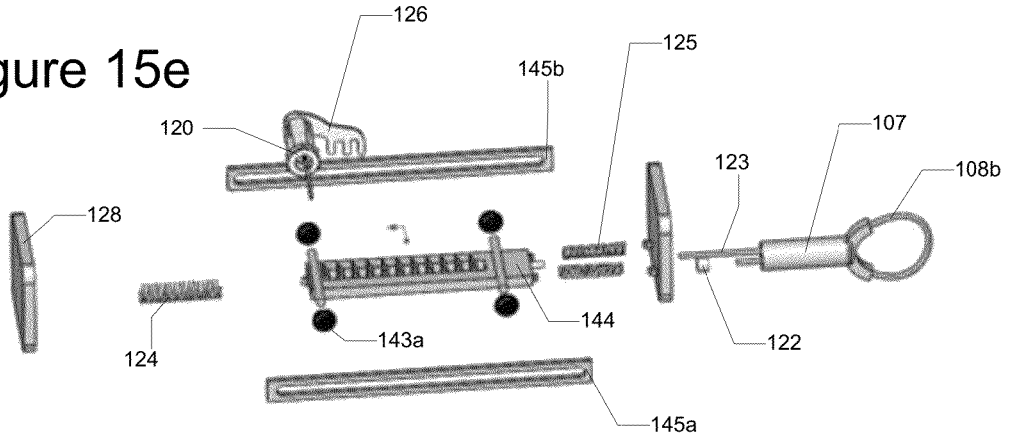

FIG. 14 shows an embodiment that does not have RFID, and instead, it can have any other types of technological solution to replace the functions of the lock 120. The lock 120 is shown as an optional feature, and it can be additional backup choice to arrest or release movement of cable/rope/chain 108*b*, or its operation can be substituted entirely by any other suitable technological solution such as a RFID, mobile application, or a Bluetooth operated mechanism, or a wi-fi solution.

FIGS. 15*a* through 15*e* illustrate a fifth embodiment of the doorknob lock assembly. In this embodiment illustrated in FIG. 15*a* through 15*e*, the inverted T-shaped sliding block 119 is replaced by a simple strong thin plate 144 that moves along 2 slidable grooves 145*a* and 145*b*, thereby reducing both the size and amount of material consumed, and making the entire assembly more compact to perform the same function.

Additionally, the objectives of using wheels 145*a* through 145*d* is to help in sliding the plate 144 with ease, and these wheels may either be replaced by ball-bearings, or other creative mechanism to cost-effectively achieve the purpose of movement of plate on the sliding grooves 145*a* and 145*b* with as little frictional loss as feasible. If ease of movement of sliding plate is achieved without wheels, the wheels may completely be dropped from the assembly design also.

Figure 16:
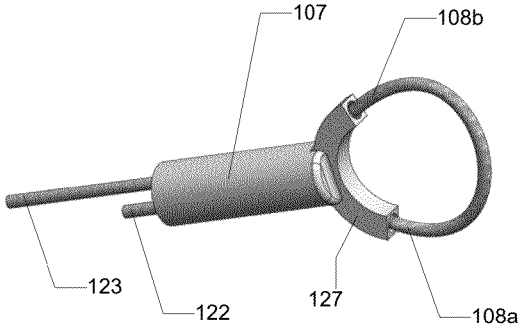
FIG. 16 shows a close-up view of stem with cables.

FIG. 16 shows a close-up view of stem 107 with cables. The stem edge has an extension that is arc-shaped 127 and it is designed to form a close and tight loop of cable/rope/chain 108*a* and 108*b* around the neck of a doorknob. The aim of all these stem edges is to improve the tamper-resisting ability to prevent the cable/rope/chain from becoming loose around the doorknob or from being removed from the doorknob.

Figure 17:
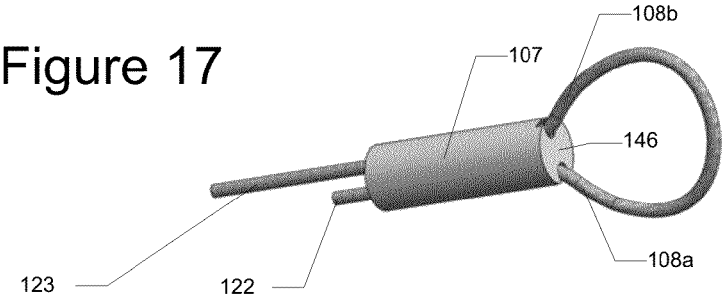
FIG. 17 shows another design where there is no extra protrusion around stem edge.

FIG. 17 shows another design where there is no extra protrusion around stem edge and for certain types and dimensions of doorknobs, this design may form a close and tight loop of cable/rope/chain 108*a* and 108*b* around the neck of a doorknob.

Figure 18A:
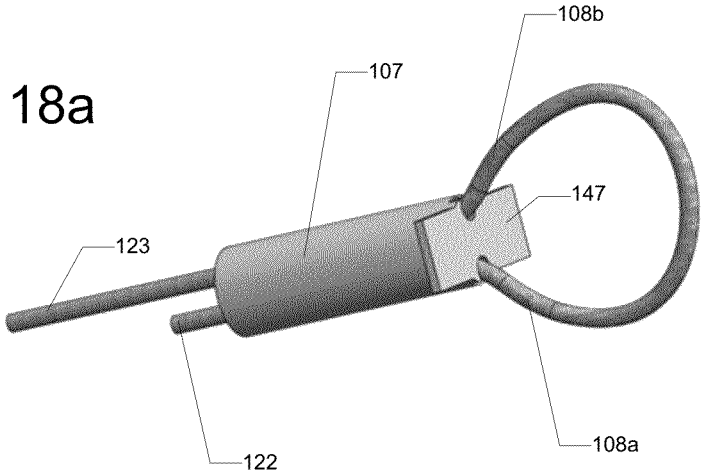
FIGS. 18*a* and 18*b* show another design where there is a small rectangular protrusion around stem edge.
Figure 18B:
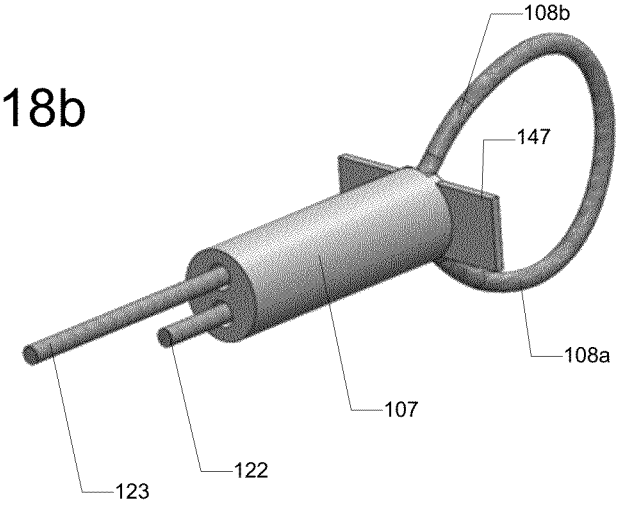

FIGS. 18*a* and 18*b* shows another design where there is a small rectangular protrusion around stem edge and for certain types and dimensions of doorknob, this design may form a close and tight loop of cable/rope/chain 108*a* and 108*b* around the neck of a doorknob. This rectangular protrusion may be suitable on certain straight-shaped doorknobs and this protrusion may help in arresting movement of cable/rope/chain, thereby preventing it from being removed from the doorknob and improving in its tamper-resisting ability.

Figure 19A:
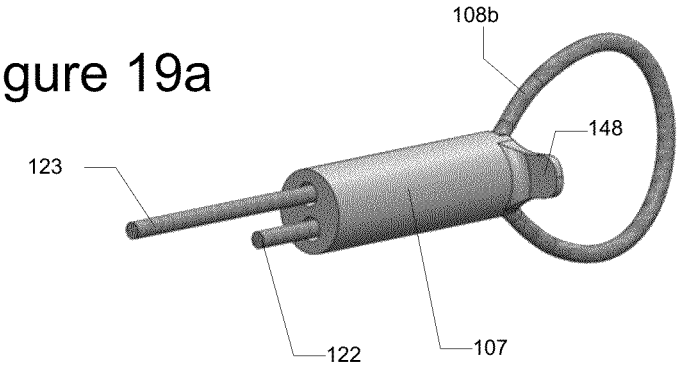
FIGS. 19*a* and 19*b* illustrates another design where there is a parabolic and/or elliptical protrusion around stem edge.
Figure 19B:
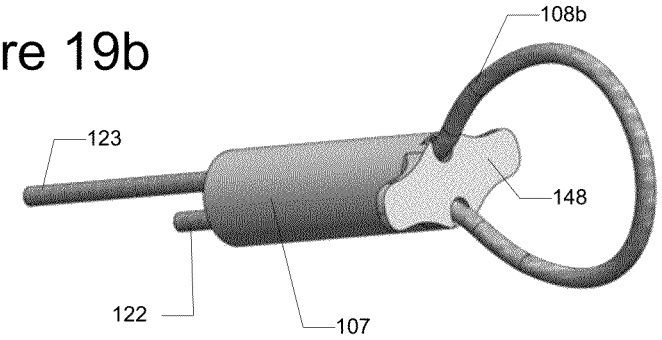

FIGS. 19*a* and 19*b* shows another design where there is a parabolic and/or elliptical protrusion around stem edge and for certain types and dimensions of doorknob, this design may form a close and tight loop of cable/rope/chain 108*a* and 108*b* around the neck of a doorknob. This shape of protrusion may be suitable on certain straight-shaped doorknobs and this protrusion may help in arresting movement of cable/rope, thereby preventing it from being removed from the doorknob.

Figure 20:
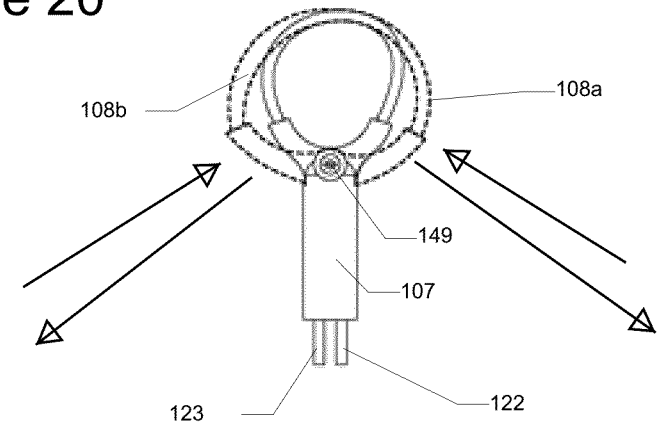
FIG. 20 illustrates a design where the stem edge is pivoted at the center to form a tight loop of cable around the neck of a doorknob.
Figure 22F:
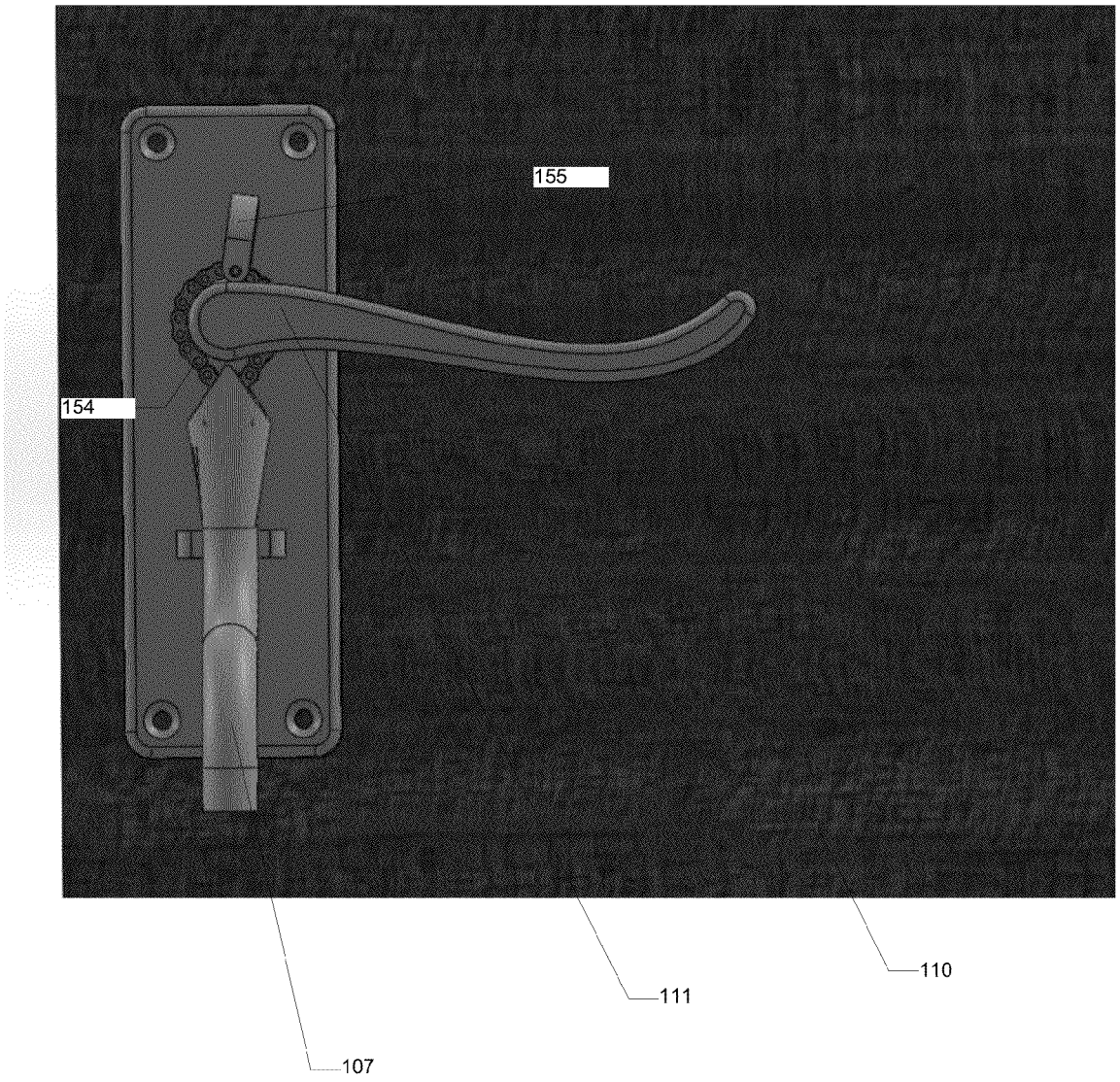
FIGS. 22*f* through 22*j* illustrate pictorially the use of chain in a A-shaped stem edge.
Figure 22G:
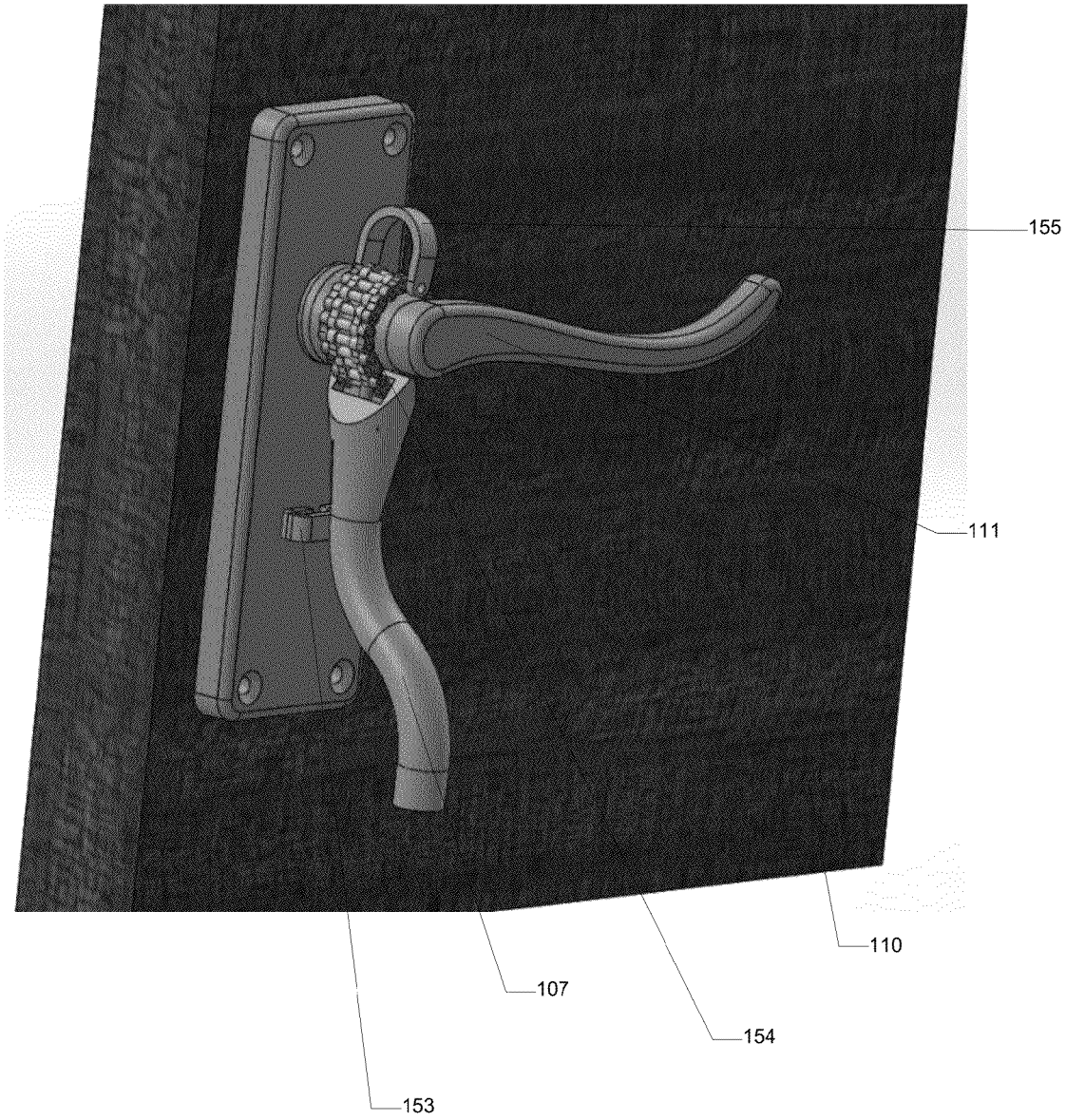
Figure 22H:
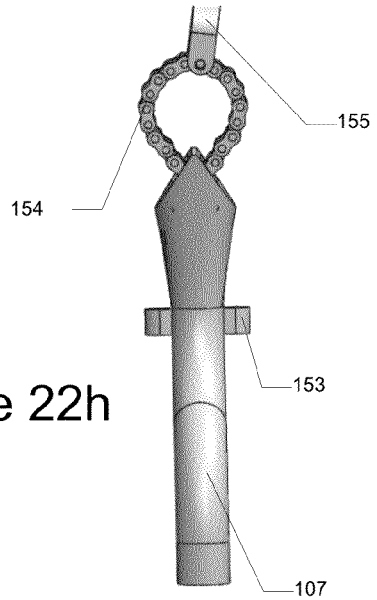
Figure 22I:
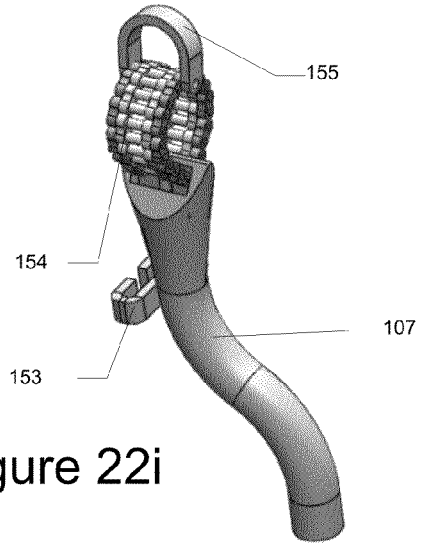
Figure 22J:
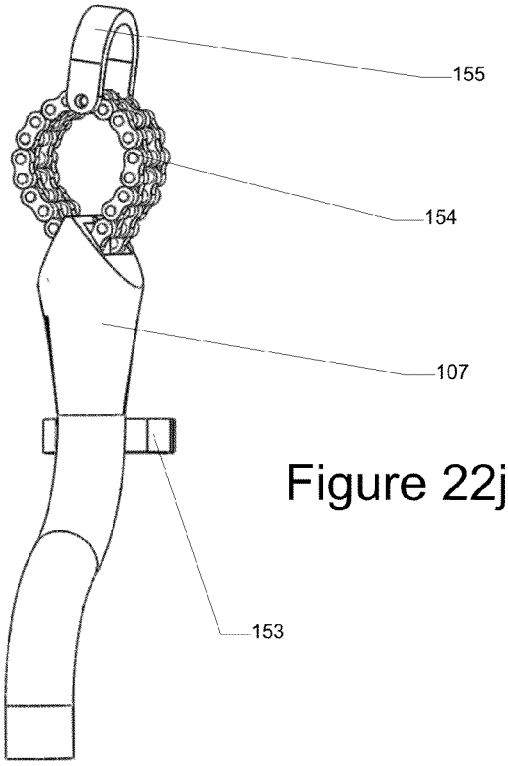
Figure 27A:
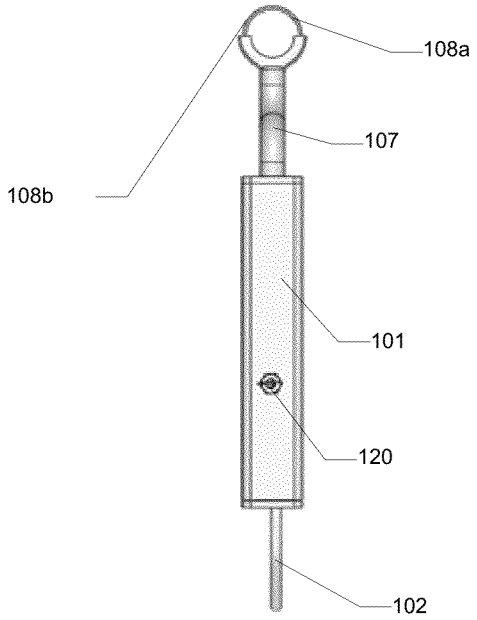
FIGS. 27*a* through 27*d* shows another embodiment of the doorknob lock assembly wherein it is hanged vertically downward from the doorknob with a lock and key mechanism that is facing outward from the front door.
Figure 27B:
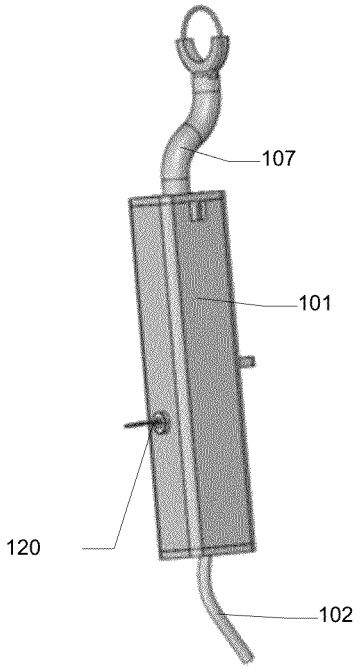
Figure 27C:
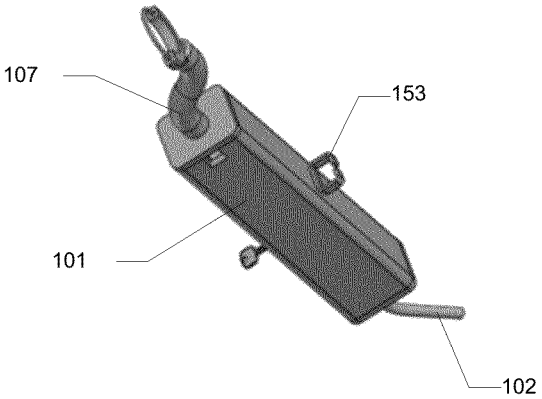
Figure 27D:
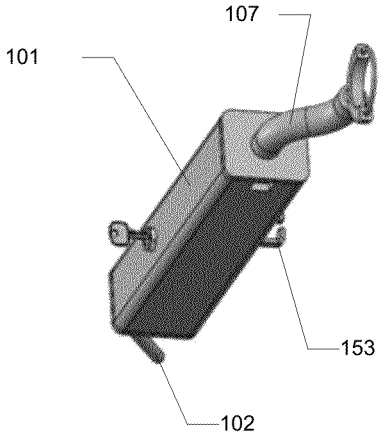

FIG. 20 shows another design where the protrusions around stem edge is pivoted at the center of the stem edge, wherein the protrusions are flexible to move around, and for certain types and dimensions of doorknob, this design may form a close and tight loop of cable/rope/chain 108*a* and 108*b* around the neck of a doorknob.

Figure 28A:
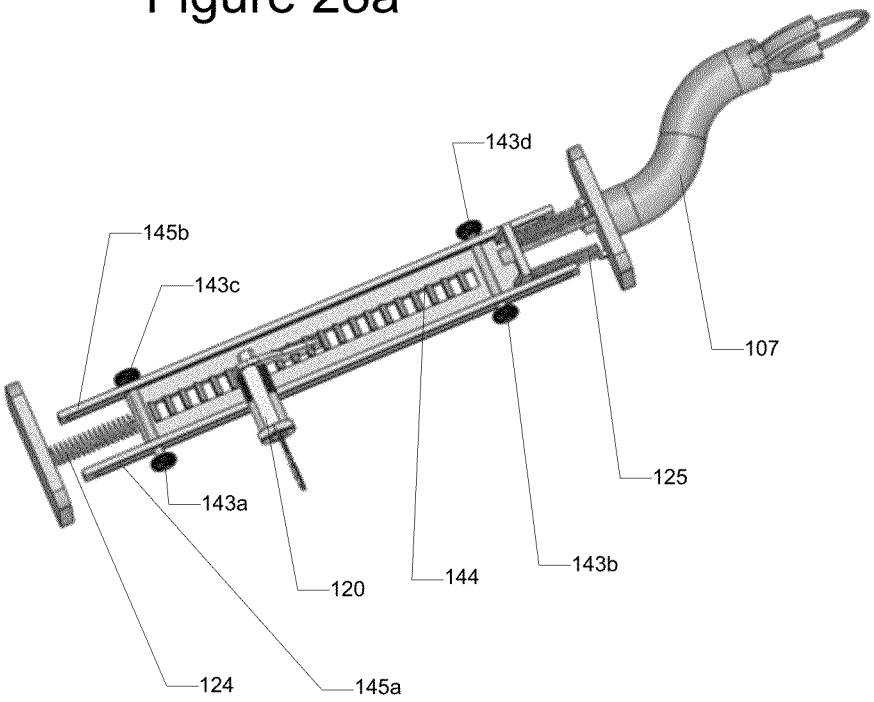
Figure 28B:
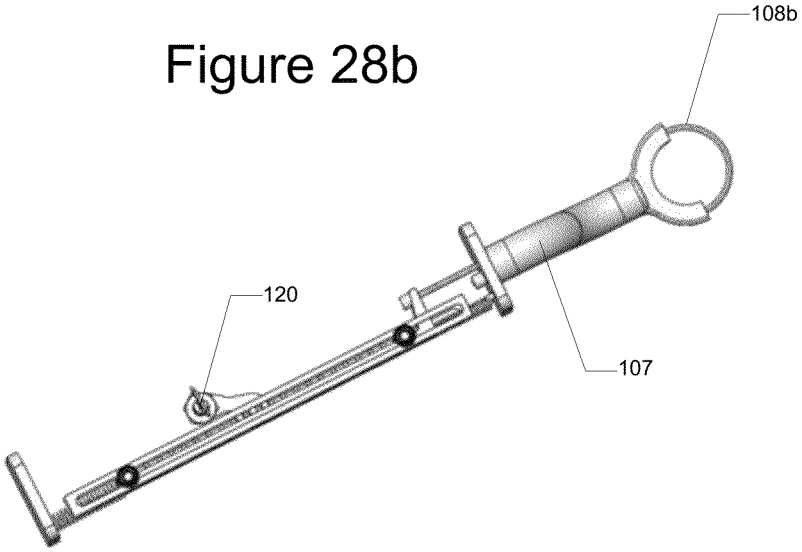
Figure 28C:
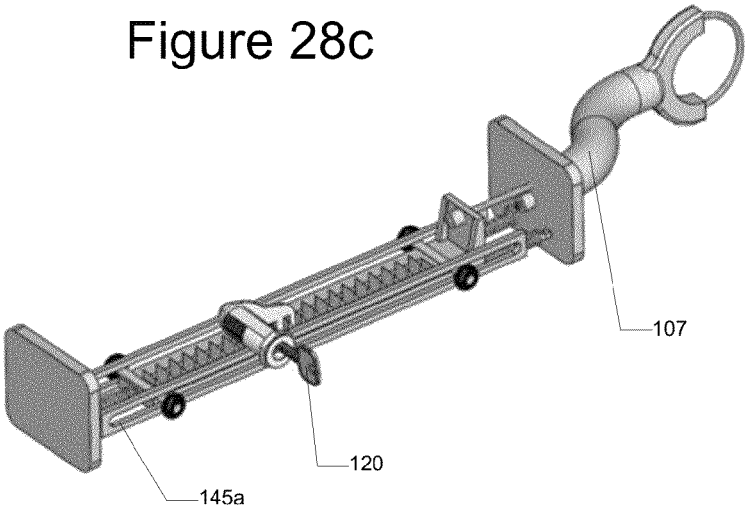
Figure 28D:
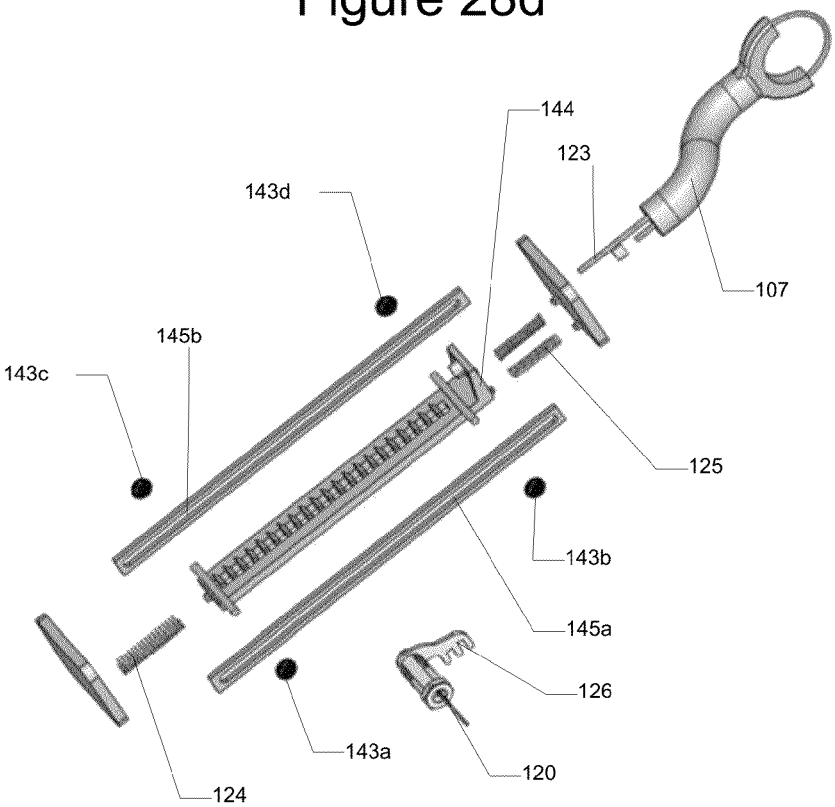
Figure 28G:
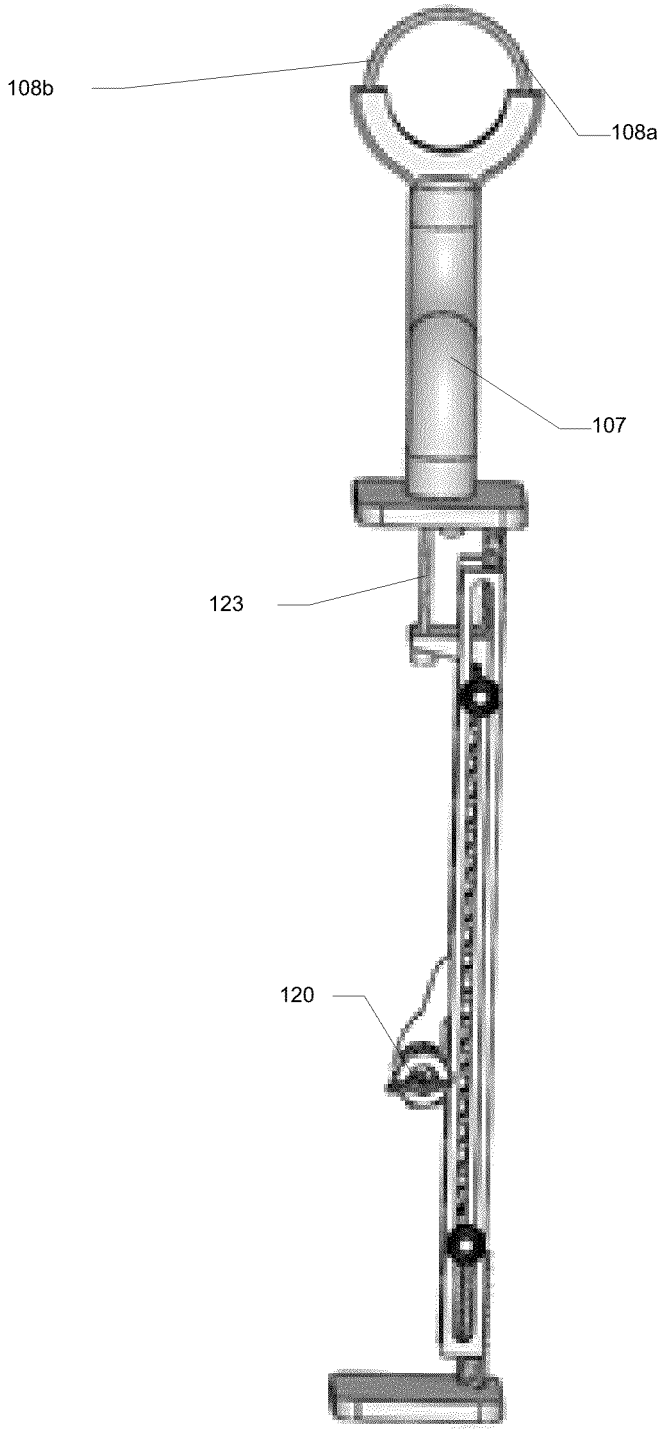
Figure 28H:
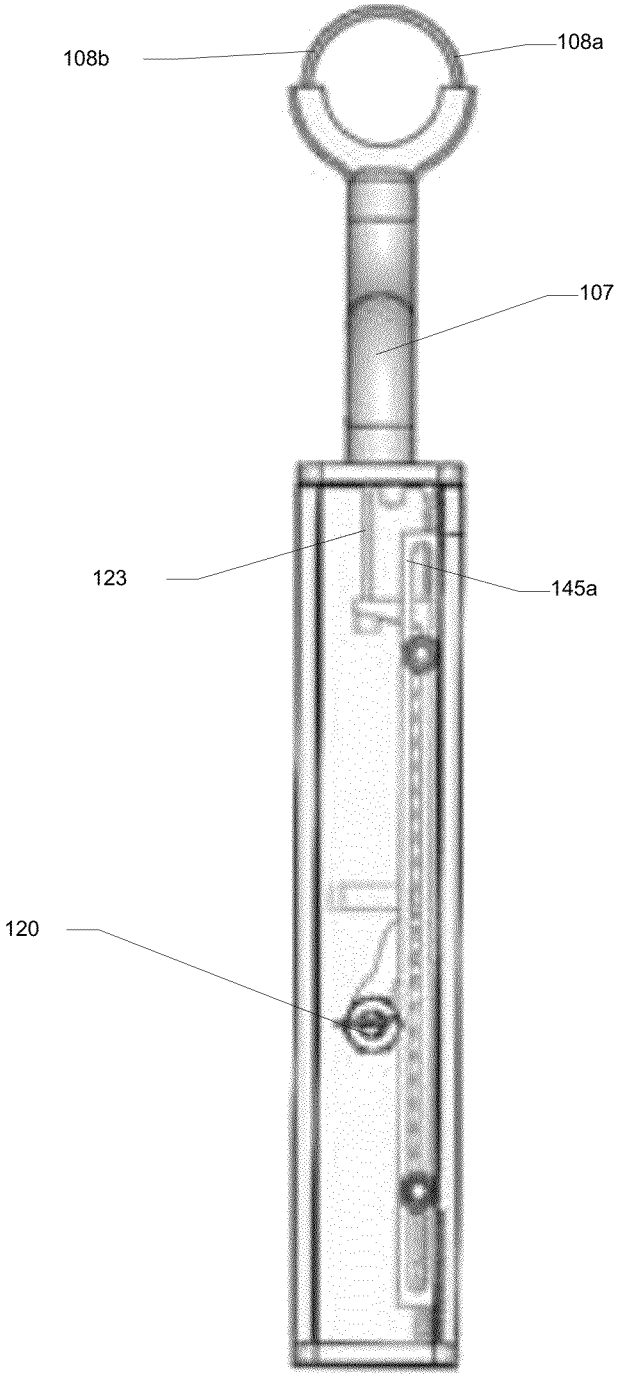
Figure 28I:
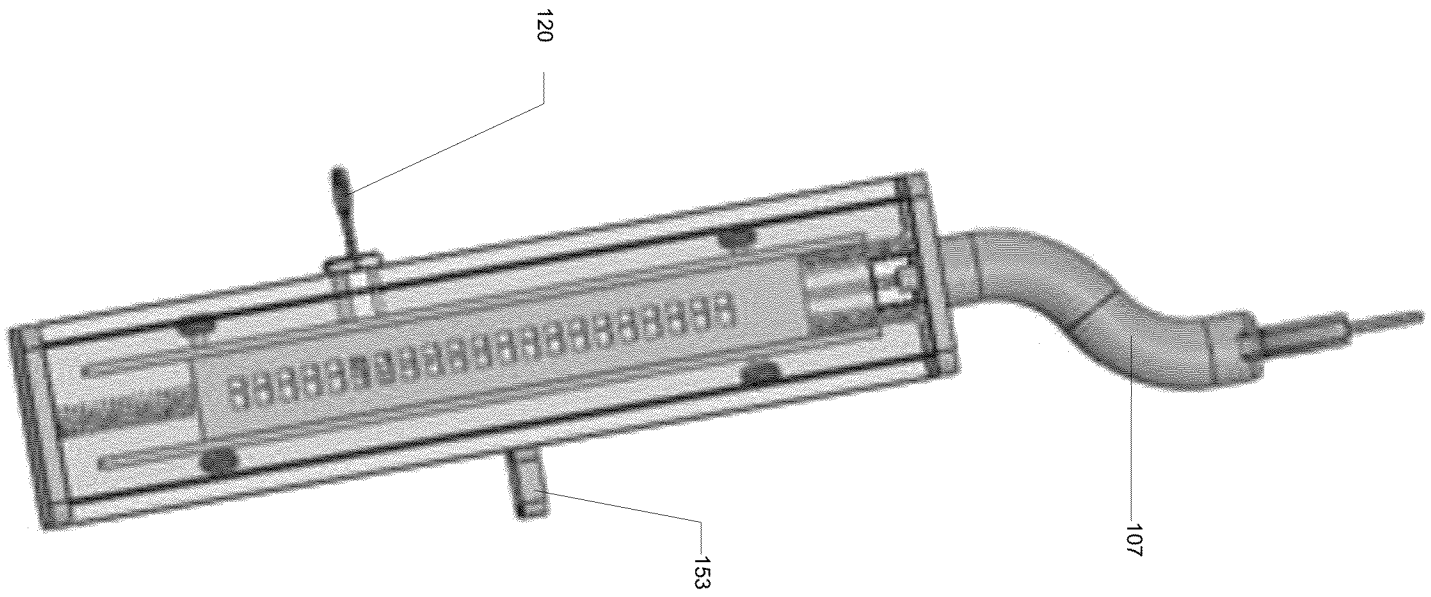

FIG. 21*a* shows another design where the stem 107 is bent so as to easily hang the doorknob lock assembly 101 vertically downward from the doorknob as shown in FIG. 28*h*. A typical apartment may have a doorknob on the left or on the right side when one is facing the door, and so one may have a tight space on the left or right side of the doorknob, respectively. Also, a typical doorknob could be of circular type or straight-type. So, this design may be very useful as this stem 107 and doorknob lock assembly 101 is hanging vertically downward, and one do not have to be concerned about tight spaces on the left or right side of the doorknob.

FIGS. 21*a* through 21*d* illustrate a stem design in which A-shaped stem edge is shown. In some cases and types of doorknobs, this may form a tight loop of cable/rope/chain 108*a* and 108*b* around the neck of a doorknob.

FIGS. 22*a* through 22*e* illustrate a stem design in which V-shaped stem edge is shown. In some cases and types of doorknobs, this may form a tight loop of cable/rope/chain 108*a* and 108*b* around the neck of a doorknob. FIGS. 22*f* through 22*j* illustrate pictorially the use of chain that is not only strong and tamper-proof but that forms a very tight loop around the neck of the doorknob to illustrate the application. The part number of chain in these figures is marked as 154 to highlight its pictorial representations, although for all practical purposes it performs the role of 108*a* and 108*b* as illustrated and described elsewhere in other figures. Additionally, an optional chain handle 155 is also shown to illustrate that a mechanism like that may be installed to facilitate pulling of chain or cable while installing and uninstalling the stem assembly around the doorknob. In the example shown, A-shaped stem edge is utilized, although many other stem designs could potentially be utilized in a typical application.

FIG. 23 is very similar to FIG. 2*a* through FIG. 4. As shown in FIG. 23 detail C, the cable/rope/chain 102 is broken into 2 pieces, and has a detachable lock and key mechanism in the middle. This cable detachment feature is provided so as to facilitate a particular user to exchange various sizes of parcel bags 103, such as extra-small, small, medium, large and extra-large, for the same doorknob lock assembly 101.

FIG. 24*a* and FIG. 24*b* shows a magnified view of the cable detachment lock and key mechanism.

FIG. 25*a* and FIG. 25*b* shows an optional embodiment in which the cable/rope/chain 108*a* and 108*b* are wrapped inside a tamper-resistant convex circular bead. This allows the cable/rope/chain 108*a* and 108*b* to be thin and flexible while at the same time it can be wrapped inside a stronger convex material such as a metal or other suitably strong material to give it significantly enhanced strength for tamper resistance. Although, a convex shaped circular bead is shown, we can use any kind of design or shape or geometry to accomplish the objectives indicated herein.

FIG. 26*a* and FIG. 26*b* are very similar to that of FIGS. 25*a*-25*b*, except these have concave shaped beads around the cable/rope/chain 108*a* and 108*b*. This allows the cable/rope/chain 108*a* and 108*b* to be thin and flexible while at the same time it can be wrapped inside a stronger concave material such as a metal or other suitably strong material to give it significantly enhanced strength for tamper resistance. Although, a concave shaped circular bead is shown, other kinds of design or shape or geometry to accomplish the objectives indicated herein.

FIGS. 27*a* through 27*d* show a new embodiment of the doorknob lock assembly 101 wherein it is hanged vertically downward from the doorknob facing outward of the front door. The benefit of this design could be broad in some cases and situations wherein the space to the left or right side of the doorknob is limited and tight. By moving the doorknob lock assembly 101 from the side of the doorknob to below the doorknob, the tight space constraint is significantly reduced if not eliminated. An optional dangling arrestor 153 is also shown in this embodiment and the purpose of this is to offset the distance created between the curved stem and the door so as to avoid dangling of the doorknob lock assembly 101. It is important to note that dangling arrestor 153 is NOT a mounting bracket of any sort and it is completely optional.

FIG. 28*a* through FIG. 28*i* shows and illustrates the various inner details and exploded views of many of doorknob lock assembly 101 and its essential components and parts. Almost all of the parts and components and their respective functions are already described earlier in other embodiments.

Figure 29A:
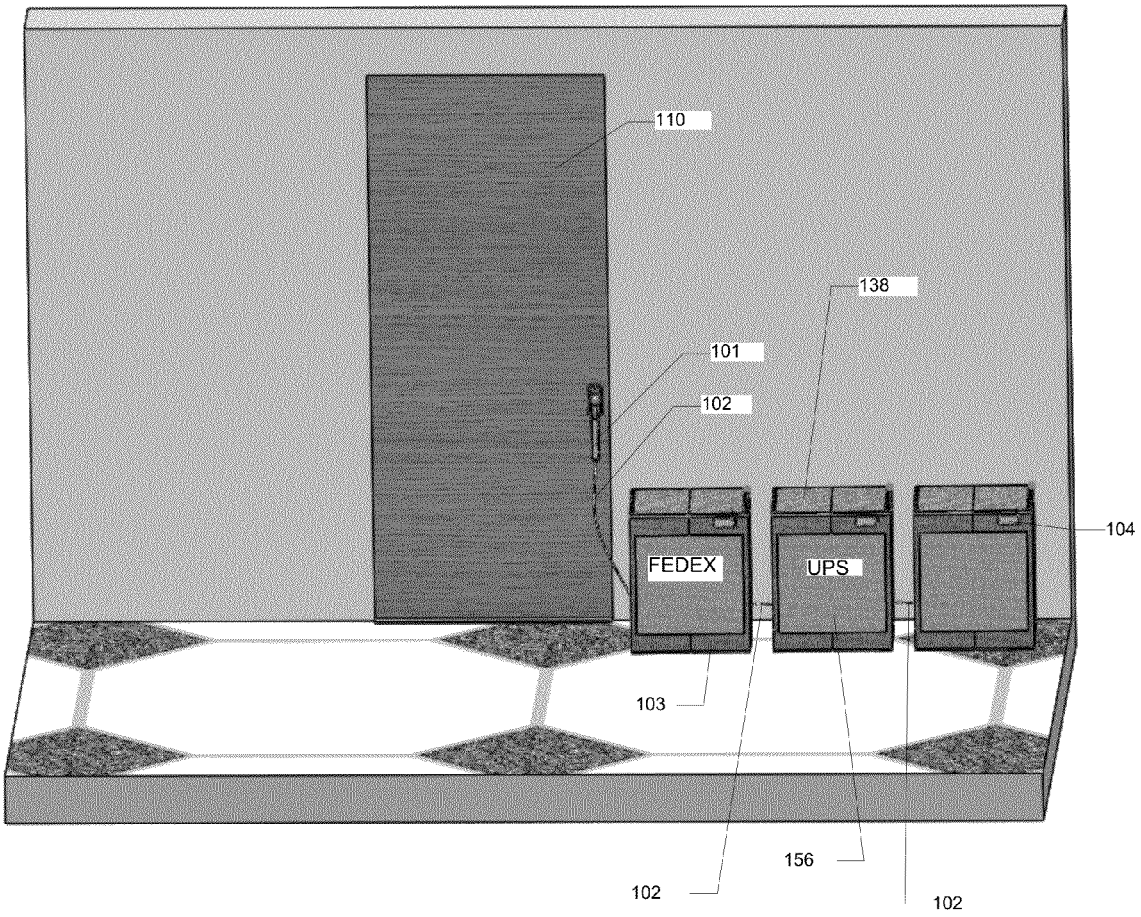
FIGS. 29*a* through 29*c* shows and illustrates how a multi-receptacle embodiment to receive multiple deliveries from multiple carriers can be achieved.
Figure 29B:
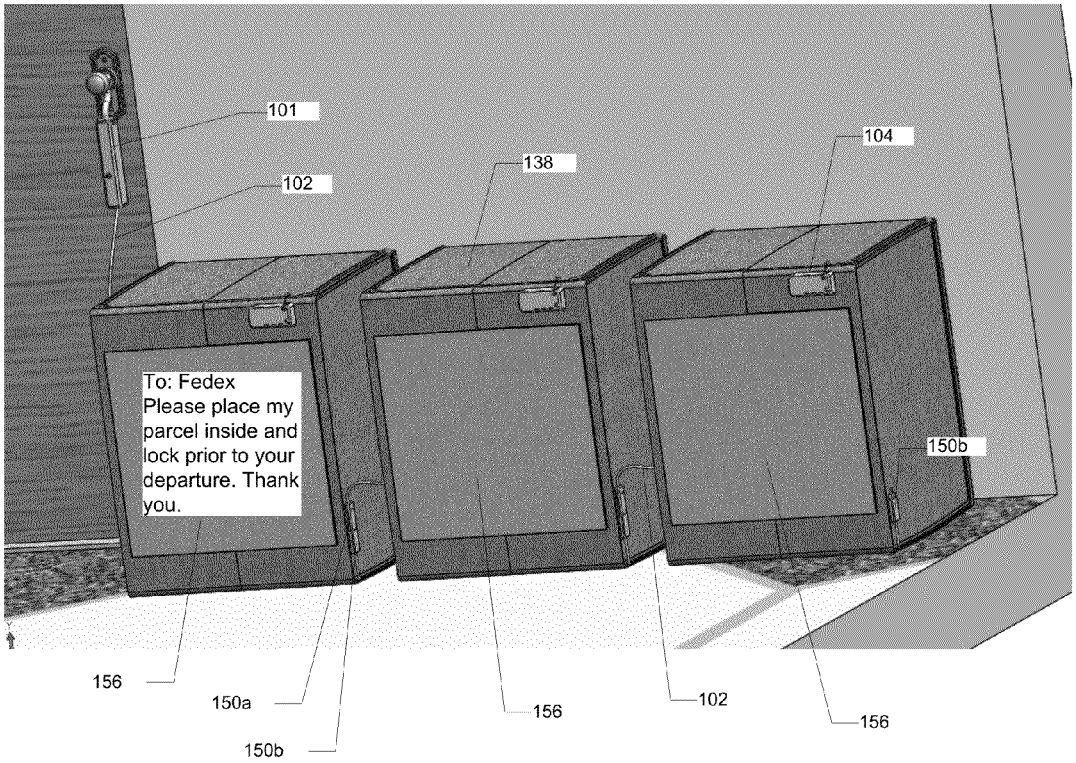
Figure 29C:
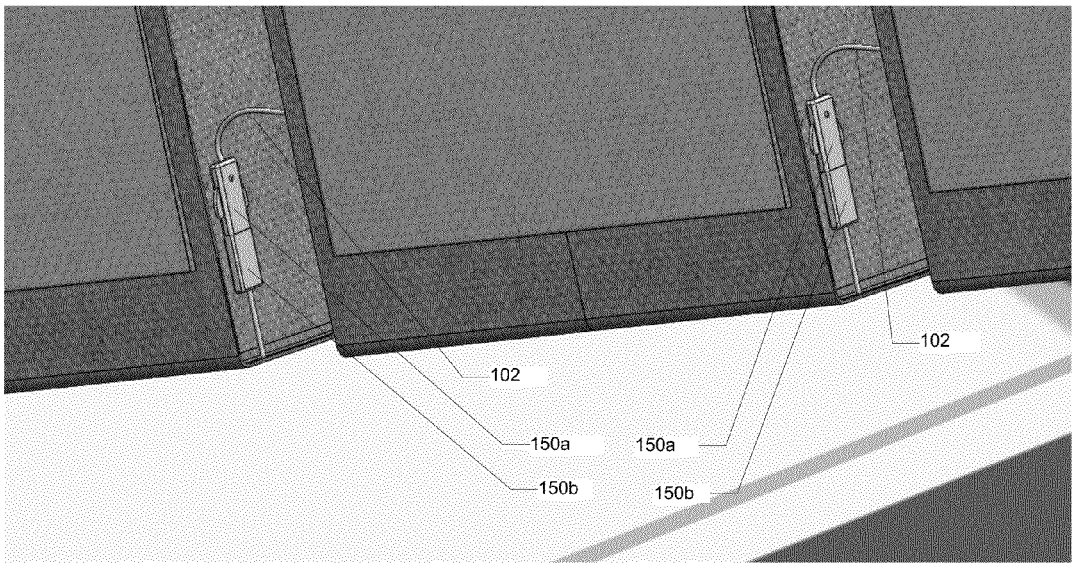

FIG. 29*a* through 29*c* shows and illustrates how multiple-receptacle embodiment to receive multiple deliveries from multiple carriers can be achieved with our apparatus and system. Essentially, the cable detachment system described in FIGS. 24*a* and 24*b* can be used repeatedly to connect one parcel bag to another until one's need for multiple deliveries are fulfilled. This design can be used with varying sizes of parcel bags. All parcel bags have a transparent message pouch that can be utilized to communicate specific delivery instruction to any mail carrier. Inclusion of the transparent message pouch on any parcel bag is an independent feature, and can be in all parcel bags irrespective of whether the delivery involves a single receptacle or multiple receptacles.

An example of a typical use of a primary embodiment is described below to help in understanding the application of this apparatus. This scenario is to provide a general understanding of a typical application and operation. It should be noted, that any real-world applications of the various embodiments can be significantly broader, and should not limited to the application described in this section.

There are 3 specific events that potentially take place while implementing the various embodiments to fulfill one's objective of receiving a parcel or delivery securely, and to eliminate or reduce the risk of losing one's parcel due to theft in front of one's front door. They are as follows:

1. Event 1: Actions of a parcel recipient or owner associated with setting up a parcel bag in front of one's apartment or place of stay to enable the receipt of parcel.
2. Event 2: Actions of a mail carrier while delivering, placing and securing the parcel inside the parcel bag at the time of delivery.
3. Event 3: Actions of the parcel recipient or owner collecting the package upon his/her return to his/her residence or business or place of stay.

Event 1: Setting Up the Parcel Bag to Enable Receipt of a Parcel

For circular (FIG. 1*a*) or straight-shaped doorknob (FIG. 1*b*), one needs to take a doorknob lock assembly (example FIG. 5*a*), and extend or loosen the cable/rope/chain (108*b*), and wrap or loop it around the doorknob, and release the cable/rope/chain (108*b*) such that rope (108*a* and 108*b*) is securely tightened around the doorknob and cannot be removed from it. The lock (120) should securely engage in its position and should not allow the rope (123, 108*b* and 108*a*) to loosen from the doorknob. Either a physical or technological solution (RFID, Bluetooth, mobile solutions or Wi-Fi) can be utilized to fulfill the function of a lock (120) and are described elsewhere in this document in greater detail. The parcel bag's zipper position (FIG. 11*a*, 139) shall remain unzipped and the parcel bag shall be open, and should allow the delivery personnel to place the parcel inside the parcel bag. Additionally, the parcel bag lock (104) will remain unlocked at this juncture, but the parcel bag shall be securely connected to the doorknob lock assembly via cable/rope/chain (102).

FIG. 2*a*, FIG. 2*b* and FIG. 2*c* illustrate the high-level overview of operations and the doorknob lock assembly involving a circular doorknob. FIG. 3 illustrates the high-level overview of operations and doorknob lock assembly involving a straight doorknob. There are several embodiments of doorknob lock assembly and are described in detail in many figures elsewhere in this document.

FIG. 4 gives a high-level overview for scenarios that involve securing the parcel bag to a door handle (FIG. 1*c*). This operation is similar to that of circular or straight doorknob, but slightly different in nature. FIG. 12*a*, FIG. 12*b* and FIG. 12*c* illustrates the usage nicely for a door handle. One needs to slide the rope with a circular metal ring (FIG. 12*a*, 117) inside the door handle, and push the rope end (115) that has a lever (118) in it and lock it in position securely. Either the lock (FIG. 4, detail A, 114) itself can be secured around the door handle as shown in FIG. 4, Detail A, or the circular metal ring (117) of the Y-shaped cable (FIG. 4, 113) can be slid inside the door handle, and into the lever (118), and can be securely locked by the lock (114). In other words, in the first option of lock 114, it will be as shown in FIG. 4 Detail A. In the second option, the circular ring 117 will go through the door handle 112, and the lock 114 will cover only 117, and not cover the handle 112 inside the lever 118 as indicated. The rivet (115) on lock (114) ensures that the lock is always connected to the parcel bag securely. The parcel bag shall remain open (FIG. 12*a* and FIG. 12*b*) as shown and shall remain unlocked with zipper (139) in the open position.

Event 2: Receiving Parcel or Deliveries

When the delivery personnel arrive at the front-door, he puts the parcel inside the parcel bag (103), and moves the zipper 139 from its position in FIG. 11*a* to its locked position shown in FIG. 11*b*. The zipper 139 is securely locks into lock (104) in such a way that the zipper cannot be opened again unless one has the key for the lock (104) or knows the numerical combination of the lock. The lock can be of numerical combination type as shown in FIGS. 11*a* and FIG. 11*b*, or any other type. Once locked, even the mail personnel shall not be able to open and access the parcel.

Event 3: Retrieving Parcel or Package

Upon return to one's residence, business or place of stay, the parcel recipient can use a key to open the doorknob lock (106 or 120) such that the lever (126) is rotated in such a fashion to allow movement of sliding block assembly (119), and loosening of rope (108*b*) to enable removal of the entire doorknob lock assembly and cable/rope/chain from the doorknob. Upon going inside one's residence or place of stay, one can unlock the parcel bag lock (104) and retrieve the contents of the parcel bag. In the door handle scenario illustrated in FIG. 4, similar procedure can be performed to remove the cable/rope/chain (113) from the lock (114) and from the door handle (112).

Table 1: Part Number and Description

In order to provide better clarity, the following table 1 is a list of indices to better understand the illustrations.

TABLE 1

Part Number and Its Description

| Part Number | Description |
|---|---|
| 101 | Doorknob locking assembly. |
| 102 | Cut-resistant cable or rope or chain. |
| 103 | Parcel bag receptacle for deliveries (Parcel bag) |

TABLE 1-continued

Part Number and Its Description

| Part Number | Description |
|---|---|
| 104 | Parcel bag lock. Can be of numerical combination type, or traditional physical type, or any other lock. The intention is to enable locking of parcel bag upon placing the parcel inside the parcel bag. |
| 105 | A typical circular doorknob. |
| 106 | Doorknob lock assembly key. |
| 107 | Doorknob lock assembly stem. This stem can have many types of geometry and shapes to fulfill the objective of providing a secure mechanism to prevent tampering of cable/rope/chain 108a, 108b, and to ensure the entire assembly fulfills its objectives effectively. Sometimes the stem is straight, and sometimes it is bent as illustrated in multiple pictures to increase the ease of locking in tight spaces around some doorknobs. |
| 108a | Doorknob cable/rope/chain. The (a) end is stationary and is riveted (122) inside to arrest movement of cable 108a. |
| 108b | Doorknob cable/rope/chain. The (b) end is pullable, movable and it is typically pulled and extended so that the cable is wrapped around a door knob to secure it tightly around the neck of a doorknob and the lock 120 is used to arrest the movement of the sliding assembly 119 to which this end of cable is directly connected as shown in cable 123. |
| 109 | Front door key hole. |
| 110 | Front door of apt or house or office. |
| 111 | A typical straight-shaped doorknob. |
| 112 | A typical door handle. |
| 113 | Y-shaped cable/rope/chain to perform locking mechanism on a door handle. |
| 114 | Door handle lock that is riveted to Y-Shaped cable. |
| 115 | Rivet between door handle lock and Y-Shaped Cable. |
| 116 | Parcel bag zipper. |
| 117 | Circular metal ring at one edge of Y-Shaped Cable. |
| 118 | Locking lever of door handle Lock. |
| 119 | Inverted T-Shaped Sliding Block With lockable grooves. [Any other geometry or shape or design may be substituted for this design to fulfill the same purpose.] The design is shown for illustrative purpose only, and for illustrating the design of the sliding block and an example of its locking mechanism. |
| 120 | Lock and Key mechanism in Doorknob lock assembly. The position of this can be in any face of the assembly to fulfill its intended purpose. Depending on whether a doorknob is on the right side, or left side, this lock location can become critical, and so it is important to convey that this lock location could be positioned anywhere to fulfill its intended objectives. |
| 121 | Triangular grooves to enable locking and arresting of movement of the inverted-T shaped sliding block. The idea is to lock and arrest the free movement of cable 108b when locked, and there is no special significant of the triangular shape in this. It can be any size, shape or geometry, or it can use any technological solution to achieve its intended objective. |
| 122 | Riveted end of cable/rope/chain (108a). |
| 123 | Movable, pullable end of cable/rope/chain (108b). |
| 124 | Extendable spring. This spring is extended when cable 108b is pulled out, and it helps in retracting the cable 108b back so as to form a tight loop around the neck of a doorknob. |
| 125 | Compressible spring. This spring is compressed when cable 108b is pulled out, and it helps in retracting the cable 108b back so as to form a tight loop around the neck of a doorknob. |
| 126 | Sliding block locking lever. |
| 127 | Arc-shaped Stem edge. |
| 128 | Outer box/shell of the doorknob locking assembly. |
| 129 | Helical spring that gets wound when cable 108b is pulled out. This helical spring is used to retract and pull back cable 108b to form a tight loop around the neck of doorknob so as to arrest tampering and removal of doorknob assembly from the doorknob. |
| 130 | Circular gear to facilitate locking and arresting of movement of cable/rope/chain 108b. When cable/rope/chain 108b is pulled out, it rotates the circular gear if it is not locked by lock 120 and lever 137. |
| 131 | Cylindrical annular chamber that stores cable/rope/chain 123 inside. |
| 132 | Rivet of helical spring onto the outer shell of doorknob locking assembly so that it is fastened and gets wound when cable/rope/chain 108b is pulled out. |
| 133 | Circular disc that seals and separates helical spring from cable/rope/chain (123) to ensure cables do not interfere or get entangled into the helical spring 129 when cable/rope 123 is loose. |
| 134 | Fastener that holds helical spring in its place. This fastener is welded onto the inside surface of the doorknob's outer shell (128). |
| 135 | Cylinder around the outside surface of which the helical spring is placed. |
| 136 | Hollow cylinder outside of which cable (123) resides. This is inside the annular space created by outside cylinder (131). |
| 137 | Circular gear lock lever. |
| 138 | Parcel bag cover or lid. |
| 139 | Parcel bag zipper. |

TABLE 1-continued

| Part Number and Its Description | |
|---|---|
| Part Number | Description |
| 140 | Cut-resistant and tamper-resistant cable/rope/chain that is integrated into the parcel bag to enhance its structural strength against tampering and vandalism and to improve safety of parcels. |
| 141 | RFID based locking mechanism that performs the same function of doorknob lock (120). This can either replace doorknob lock 120, or can be optional additional feature of doorknob lock assembly as an alternate embodiment. |
| 142 | Speaker. [Loud sound will be created if there is any tampering of the parcel receptacle or doorknob lock assembly or tampering of any inter-connecting cables is noticed.] |
| 143a, 143b, 143c, 143d | Wheels to assist movement of sliding plate along the grooves (145a, 145b). |
| 144 | Sliding plate with rectangular openings. Has triangular shaped sliding wedge between any two rectangular openings to help the locking lever (126) slide and fall into position and arrest movement of sliding plate along the slidable grooves (145a and 145b), thereby preventing movement of cables (123) to ensure cable (108b) remains tight around doorknob. |
| 145a, 145b | Grooves for slidable plate. |
| 146 | Stem edge. |
| 147 | Rectangular plate at stem edge to arrest shaking and movement of stem (107) and cables (108a and 108b) to avoid loosening of cables of doorknob assembly from straight-shaped doorknob (111), thereby securing everything tightly in its place. |
| 148 | Curved plate at stem edge to arrest shaking and movement of stem (107) and cables (108a and 108b) to avoid loosening of cable/rope/chain of doorknob assembly from straight-shaped doorknob (111), thereby securing everything tightly in its place. |
| 149 | Flexible-pivoting at stem edge to facilitate movement of arc-shaped stem edge (127) around center to form a tight loop of cable (108) around doorknob. |
| 150a, b | Lock and key mechanism for cable detachment. This is provided so that customers can buy multiple sizes of parcel bags 103 such as extra-small, small, medium, large and extra-large and can use the same doorknob assembly for each one by disconnecting one size of parcel bag, and attaching and locking another size of parcel bag. For identification purposes, 150a represents the female portion of this lock, and 150b represents the male portion of the lock. |
| 151 | Convex shaped circular bead to protect cable 108a, 108b from being cut or tampered. Can be made of metal or any other material that allows the cable to be flexible yet completely tamper-resistance. Can have any shapes to fulfill its intended objective of offering tamper-resistance. |
| 152 | Concave shaped circular bead to protect cable 108a, 108b from being cut or tampered. Can be made of metal or any other material that allows the cable to be flexible yet completely tamper-resistance. Can have any shapes to fulfill its intended objective of offering tamper-resistance. |
| 153 | Dangling arrestor (and not a mounting bracket that is fixed to any stationary objects that prevent movement of doorknob lock assembly 101). This is just to offset the bend in stem 107 so that the doorknob lock assembly 101 is not dangling because of uneven weight distribution of a bent stem 107. This is an entirely optional component, and is not a mandatory or an essential component. |
| 154 | A flexible chain, instead of a typical cable that is pictorially represented as 108a and 108b in many other figures, is shown. This chain can be utilized in any of the embodiments to form a tight loop around the doorknob. |
| 155 | A chain handle to pull the chain or cable (108b) is shown and can be utilized during installation and uninstallation of the stem assembly around the doorknob. This is not a bracket and it is optional, and this is provided for ease of pulling the cable 108b or chain 154 to wrap it around or remove from the doorknob. |
| 156 | A transparent message pouch. Can be used for any communication to a mail carrier. |

In the drawings, descriptions and specifications discussed above, there are disclosed a few typical embodiments of the invention. Although specific terms and elements are used in description, they are used in a descriptive sense only, and not for the purpose of limitation. It is apparent, however, that various modifications and changes can be made in the specifications, elements to create a greater number of embodiments without departing from the spirit and scope of the invention. The method and apparatus is a utility product assembly that can have several embodiments and each embodiment has one or more of the following features to securely receive a package. The essential advantages of the various embodiments of the apparatus, method and mechanism are many, and should not be limited to the particular examples provided above.

I claim:

1. A system for securely receiving or exchanging a parcel at a residence or any place of stay comprising:

an attachment having a first tamper-proof cable connected to the attachment and configured to secure the attachment to an existing doorknob or door handle, said attachment enclosed in a tamper-proof housing;

a door handle locking mechanism located in said tamper-proof housing, wherein the door handle locking mechanism is configured to secure the attachment to the doorknob or door handle to prevent removal of the attachment from the doorknob or door handle;

a door handle unlocking mechanism integrated with the door handle locking mechanism, wherein the door handle unlocking mechanism is configured to release the attachment from the doorknob or door handle to allow removal of the attachment from the doorknob or door handle;

a second tamper-proof cable connected to the tamper-proof housing;

a parcel bag connected to the second tamper-proof cable;

a parcel locking mechanism attached to the parcel bag, wherein the parcel locking mechanism is configured to lock and prevent the parcel bag from opening; and a parcel unlocking mechanism integrated with the parcel locking mechanism, wherein the parcel unlocking mechanism is configured to unlock the parcel locking mechanism and allow the parcel bag to open.

2. The system as recited in claim 1 wherein said system is portable and can be attached or detached and does not require any frame or mounting bracket assembly for its operation.

3. The system as recited in claim 1, further including an audible intrusion alarm that sounds to deter any unauthorized tampering or forceful entry or actions to retrieve contents of the parcel bag, wherein the audible intrusion alarm is integrated with the tamper-proof housing and the parcel bag.

4. The system as recited in claim 1, wherein said parcel unlocking mechanism includes an electronic system for identifying an authorized individual and opening.

5. The system as recited in claim 4, wherein said electronic system includes an RFID for identifying the authorized individual and opening.

6. The system as recited in claim 4, wherein said parcel unlocking mechanism includes a wireless receiver.

7. A method for securely receiving a parcel, comprising:

providing a doorknob locking assembly configured to securely connect to a door handle or a doorknob;

providing a tamper-proof parcel bag;

providing a cable assembly for connecting the doorknob locking assembly to the door handle or doorknob, and connecting the parcel bag to the doorknob locking assembly; and providing a locking mechanism attached to the tamper-proof parcel bag, wherein the locking mechanism is configured to prevent the opening of a sealed parcel bag by any unauthorized individual.

8. The method as recited in claim 7, wherein, the doorknob locking assembly can be connected to the doorknob or the door handle, and disconnected from the doorknob or door handle only by authorized individuals.

9. The method as recited in claim 8, wherein the cable assembly includes a door handle cable integrated with the doorknob locking assembly and oriented in such a way so as to wrap around or connect to the door handle or the doorknob to minimize movement of the door handle cable in relation to the door handle or the doorknob, thereby preventing the removal of the doorknob locking assembly from the door handle or the doorknob.

10. The method as recited in claim 9, wherein a stem integrated with the doorknob locking assembly reduces exposure of the door handle cable to tampering.

11. A device for securely receiving a delivery, comprising:

a first securing cable, wherein the first securing cable is oriented at a first end to fit around a doorknob or door handle such that it cannot be dislodged therefrom;

the first securing cable connected to and protected by a doorknob security enclosure at a second end, said doorknob security enclosure including a doorknob security lock integrated with the doorknob security enclosure;

the doorknob security enclosure attached to a secure delivery receptacle via a second securing cable; and a security device attached to the secure delivery receptacle, wherein the security device is configured to prevent unauthorized access to the secure delivery receptacles.

12. The device for securing a delivery as recited in claim 11, wherein said second securing cable is comprised of two parts with complimentary parts of a lock securing said two parts.

13. The device for securing a delivery as recited in claim 12, wherein said complimentary parts include an RFID.

14. The device for securing a delivery as recited in claim 11, wherein said secure delivery receptacle is a tamper-proof bag made of a rugged material.

15. The device for securing a delivery as recited in claim 11, wherein said doorknob security lock includes a locking gear and a release mechanism which releases said doorknob security enclosure from said doorknob or door handle.

16. The device for securing a delivery as recited in claim 15, wherein said doorknob security lock includes an RFID configured to operate the release mechanism.

17. The device for securing a delivery as recited in claim 15, wherein said doorknob security lock includes a lock and key combination configured to operate the release mechanism.

18. The device for securing a delivery as recited in claim 15, wherein said doorknob security enclosure includes a doorknob or door handle tampering guard.

19. The device for securing a delivery as recited in claim 15, further comprising a speaker and an alarm integrated within the doorknob security enclosure, wherein the speaker is operatively connected to the alarm.

20. The device for securing a delivery as recited in claim 19, wherein said alarm notifies a receiving device upon activation.

21. The device for securing a delivery as recited in claim 11, wherein said security device lock automatically by the placement of a delivery in said secure delivery receptacle.

22. The device for securing a delivery as recited in claim 11, further comprising a messaging pouch attached to said secure delivery receptacle.

23. A device for securing a delivery, comprising:

a delivery receptacle including at least one receptacle port; said delivery receptacle including an individual security cover for said receptacle port;

said individual security cover including a locking mechanism configured to lock the individual security cover onto the receptacle port once an item is placed inside said receptacle port;

said individual security cover configured to be unlocked by an unlocking mechanism integrated with the individual security cover;

said delivery receptacle connected to a doorknob security apparatus via a first security cable; and said doorknob security apparatus including a retractable second security cable attached to the doorknob security apparatus, said second security cable removably securing said doorknob security apparatus to a doorknob or a door handle.

24. The device for securing a delivery as recited in claim 23, wherein said unlocking mechanism is configured to unlock the individual security cover wirelessly.

25. The device for securing a delivery as recited in claim 23, further comprising a messaging pouch attached to said delivery receptacle.

* * * * *